US009556620B2

(12) United States Patent
Cappelle et al.

(10) Patent No.: US 9,556,620 B2
(45) Date of Patent: Jan. 31, 2017

(54) FLOOR PANEL FOR FORMING A FLOOR COVERING, FLOOR COVERING FORMED OF SUCH FLOOR PANELS, AND METHOD FOR MANUFACTURING SUCH FLOOR PANELS

(71) Applicant: FLOORING INDUSTRIES LIMITED, SARL, Bertrange (LU)

(72) Inventors: Mark Cappelle, Staden (BE); Pieter Devos, Koolskamp (BE); Christophe Naeyaert, Jabbeke (BE)

(73) Assignee: FLOORING INDUSTRIES LIMITED, SARL, Bertrange (LU)

( * ) Notice: Subject to any disclaimer, the term of this patent is extended or adjusted under 35 U.S.C. 154(b) by 0 days.

(21) Appl. No.: 14/760,131

(22) PCT Filed: Jan. 13, 2014

(86) PCT No.: PCT/IB2014/058226

§ 371 (c)(1),
(2) Date: Jul. 9, 2015

(87) PCT Pub. No.: WO2014/108875

PCT Pub. Date: Jul. 17, 2014

(65) Prior Publication Data

US 2015/0337542 A1 Nov. 26, 2015

Related U.S. Application Data

(60) Provisional application No. 61/919,049, filed on Dec. 20, 2013, provisional application No. 61/751,521, filed on Jan. 11, 2013.

(51) Int. Cl.
*E04F 15/02* (2006.01)
*E04B 5/02* (2006.01)
(Continued)

(52) U.S. Cl.
CPC ..... *E04F 15/02038* (2013.01); *E04B 5/02* (2013.01); *E04C 2/20* (2013.01); *E04C 2/38* (2013.01);
(Continued)

(58) Field of Classification Search
CPC ..... F16B 5/02056; F16B 5/0056; E04F 2201/0552; E04F 2201/0558; E04F 2201/0594; E04F 2201/0138; E04F 15/02; E04F 15/02038; E04F 2201/0176; E04F 2201/0523; E04F 2201/0115; E04F 2201/0588; E04F 2201/049; E04F 15/04; E04F 15/10; E04F 2201/0505; E04F 2201/0146; E04F 2201/05; Y10T 403/54; Y10T 403/581; Y10S 292/38; Y10S 292/53; E04C 2/38; E04C 2/20; E04B 5/02
(Continued)

(56) References Cited

U.S. PATENT DOCUMENTS 7,841,145 B2 * 11/2010 Pervan ..... E04F 15/02038 52/391
8,024,904 B2 * 9/2011 Hannig ..... E04F 15/02 428/50
(Continued)

FOREIGN PATENT DOCUMENTS

DE 102006011887 A1 7/2007
EP 1276941 A1 1/2003
(Continued)

OTHER PUBLICATIONS

International Search Report for corresponding International PCT Application No. PCT/IB2014/058226, Jul. 2, 2014.

*Primary Examiner* — Babajide Demuren
(74) *Attorney, Agent, or Firm* — Workman Nydegger

(57) ABSTRACT

A floor panel for forming a floor covering includes coupling parts on at least one pair of opposite arranged to allow that two of such floor panels can be joined by means of a downward movement (M) of one floor panel in respect to the other floor panel. The coupling parts allow a locking in a first direction perpendicular to the plane of the floor panels as well as in a second direction perpendicular to the respective edge and in the plane of the floor panels. A longitudinal recess located on at least one of the edges is present underneath the upper surface with a locking element. The shape and/or the position of the recess and/or the configuration of the coupling parts is such that deformations are avoided.

30 Claims, 10 Drawing Sheets

(51) Int. Cl.
*E04C 2/38* (2006.01)
*E04C 2/20* (2006.01)
*E04F 15/10* (2006.01)

(52) U.S. Cl.
CPC ..... *E04F 15/10* (2013.01); *E04F 15/02* (2013.01); *E04F 2201/0138* (2013.01); *E04F 2201/0146* (2013.01); *E04F 2201/05* (2013.01); *E04F 2201/0505* (2013.01); *E04F 2201/0523* (2013.01); *E04F 2201/0552* (2013.01); *E04F 2201/0588* (2013.01); *E04F 2201/0594* (2013.01); *Y10T 403/54* (2015.01)

(58) Field of Classification Search
USPC ..... 52/582.1, 588.1, 581, 582.2, 590.2
See application file for complete search history.

(56) References Cited

U.S. PATENT DOCUMENTS

| | | | | |
|---|---|---|---|---|
| 8,091,238 | B2 | 1/2012 | Hannig | |
| 8,220,217 | B2 * | 7/2012 | Muehlebach | E04F 15/02 403/320 |
| 2003/0024199 | A1 * | 2/2003 | Pervan | E04F 15/02005 52/589.1 |
| 2004/0035078 | A1 * | 2/2004 | Pervan | B27F 1/06 52/589.1 |
| 2004/0068954 | A1 * | 4/2004 | Martensson | E04F 15/02 52/592.1 |
| 2005/0208255 | A1 * | 9/2005 | Pervan | B32B 21/02 428/60 |
| 2007/0006543 | A1 * | 1/2007 | Engstrom | E04F 15/02 52/582.1 |
| 2007/0028547 | A1 * | 2/2007 | Grafenauer | E04F 13/10 52/586.1 |
| 2008/0066415 | A1 * | 3/2008 | Pervan | E04F 15/02 52/588.1 |
| 2008/0236088 | A1 | 10/2008 | Hannig | |
| 2009/0000232 | A1 * | 1/2009 | Thiers | B44C 1/26 52/588.1 |
| 2009/0019806 | A1 * | 1/2009 | Muehlebach | E04F 15/02 52/588.1 |
| 2010/0281803 | A1 * | 11/2010 | Cappelle | E04F 15/02 52/309.1 |
| 2011/0030303 | A1 | 2/2011 | Pervan et al. | |
| 2012/0073235 | A1 | 3/2012 | Hannig | |
| 2012/0291387 | A1 | 11/2012 | Keane | |

FOREIGN PATENT DOCUMENTS

| | | | |
|---|---|---|---|
| WO | 9747834 | A1 | 12/1997 |
| WO | 2008083662 | A1 | 7/2008 |
| WO | 2009066153 | A2 | 5/2009 |

* cited by examiner

FLOOR PANEL FOR FORMING A FLOOR COVERING, FLOOR COVERING FORMED OF SUCH FLOOR PANELS, AND METHOD FOR MANUFACTURING SUCH FLOOR PANELS

This application claims the benefit under 35 U.S.C. 119(e) to the U.S. provisional applications No. 61/751,521 filed on Jan. 11, 2013 and No. 61/919,049, filed on Dec. 20, 2013.

BACKGROUND

1. Field of the Art

In the first place, this invention relates to a floor panel for forming a floor covering, as well as to a floor covering formed of such floor panels, as well as to a method for manufacturing such floor panels. More generally, it can also be applied with other panels than floor panels, thus, for forming other coverings than floor coverings.

More particularly, the invention relates to a panel, more particularly a floor panel, wherein the floor panel, on at least one pair of opposite edges, comprises coupling parts allowing that two of such floor panels can be joined by means of a downward movement of one floor panel in respect to the other floor panel, wherein these coupling parts allow a locking in a first direction perpendicular to the plane of the floor panels as well as in a second direction perpendicular to the respective edge and in the plane of the floor panels. Such downward movement must be seen according to a cross-section of the edges to be coupled. It can be, for example, the result of the application of the so-called "fold-down" installation technique for floor panels, or can also be the result of the application of other installation techniques, for example, the technique according to which the two panels are pressed together at the respective edges by means of a mutual plane-parallel displacement of the edges. It is noted that such downward movement, seen in cross-section in respect to the edges, does not have to be a purely downward movement, but that it possibly can also be combined with, for example, minor sideward displacements, for example, for letting certain locking parts pass along each other.

2. Related Art

An example of such type of floor panels is known, amongst others, from the international patent application WO 2009/066153.

SUMMARY OF THE DISCLOSURE

The present invention in general aims at creating a new possibility which allows further optimizing the floor panels of the aforementioned type.

To this aim, the invention in the first place, thus, according to a first aspect, relates to a floor panel for forming a floor covering, wherein the floor panel, on at least one pair of opposite edges, comprises coupling means, more particularly coupling parts, allowing that two of such floor panels can be joined by means of a downward movement of one floor panel in respect to the other floor panel, wherein these coupling parts allow a locking in a first direction perpendicular to the plane of the floor panels as well as in a second direction perpendicular to the respective edge and in the plane of the floor panels, wherein on at least one of said edges a longitudinal recess is present underneath the upper surface, characterized in that the shape and/or the position of the recess in the proximity of at least one end of the respective edge is different in respect to a portion of the recess situated more proximally in the longitudinal direction of the edge. As will be explained herein more detailed, the aforementioned term "different" as one of the possibilities of the invention also comprises the possibility according to which the recess is "non-existent" on such respective end, in other words, is completely closed or is not present. When the recess in the proximity of the respective end is not completely closed, preferably a material increase shall be provided at the location of the prolongation of the normal location of the recess.

Herein, the recess preferably relates to a groove-shaped recess, which is open laterally.

More particularly, herein it is preferred that the respective edge comprises at least a central portion in which the recess extends substantially straight-lined and has a substantially uniform cross-section, and at least one end portion in which the cross-section of the recess, in respect to shape and/or position, is at least altered, or the recess is non-existent.

As the recess locally alters its shape or even is non-existent towards one or both ends of the edge, the manufacturer of such floor panels obtains an additional parameter, by which additional advantages can be created.

So, for example, an alteration can be applied which provides for a reinforcement of the pertaining corner portion of the panel, which corner portion is adjacent to the upper surface of the floor panel. In fact, it is so that, when a recess is applied which continues on the same level, irrespective whether this is a recess intended for forming a locking edge, a recess for providing a separate locking element therein, or a recess with any other purpose, this results in that the material portion present above the recess, which herein after is named the "uppermost edge zone", is easier to deform and, for example, when joining the panels, can be subjected to undesired deformations, which deformations may be objectionable and/or permanent and/or may cause damages. By configuring the recess in such a manner that the material portion in said uppermost edge zone is less sensitive to deformations towards the end of the edge, said deformations can be excluded.

The invention can also offer the advantage that, when initially shifting and pushing a floor panel against an already installed floor panel, thus, before the floor panel is pivoted down, the risk of a visible and permanent damage as a consequence of the pushing movement is reduced.

According to another possibility, an alteration can be applied which forms an end stop for an element present in the recess. Amongst others, such end stop offers the advantage that a locking strip provided in the recess, for example, a locking strip on a short side of a panel, is always kept sufficiently far from the edge of a long side of the panel. This may be useful in the case of floor panels which have to be installed according to the so-called "fold-down" principle, wherein it is often appropriate for the good functioning that the locking strip, which is provided on the short side, is situated with its distal end at a certain distance from the long side.

According to another possibility, the alteration can be configured to form a stop preventing that, when applying the so-called "fold-down" installation technique of floor panels, wherein the floor panels, at the edge which have to be coupled to an already installed panel by means of a downward movement, comprise a recess, as aforementioned, such that, when presenting the new floor panel to be installed, this latter, in upward-turned condition, comes to sit with a small distance over the upper edge of the floor panel already installed in the same row. As the stop prevents or at least minimizes this, it is obtained that the upper side edge of the floor panel to be pivoted down always moves smoothly along the upper side edge of the already installed floor panel, even if there are certain tensions among the floor panels, either desired tensions, such as a so-called pretension forcing the floor panels towards each other, as well as undesired tensions, which may occur in that the respective floor panels are not presented to each other in a perfectly correct manner, or in that the panel edges, which have to be coupled via a lowering movement, are not one hundred percent parallel to each other, such as a consequence of deviations from the perpendicularity of the floor panels.

According to a preferred embodiment, the floor panel is characterized in that the edge provided with the recess comprises a central portion in which the recess extends substantially straight-lined and has a substantially uniform cross-section and comprises at least one end portion in which the cross-section of the recess is at least altered in respect to shape and/or position or in which the recess is non-existent; and further in that the central portion extends at least over ⅓ and preferably even over at least ½ of the length of the respective edge. Thereby is obtained that the portion in which the recess is present in its normal shape shows a relatively considerable length in which the normal functionalities, for which the recess is intended, can be maintained. With other proportions, too, it is preferred that there is a central portion with a uniform cross-section.

According to another preferred embodiment, the floor panel is characterized in that towards said end more material is present at the upper side. In this manner, it is obtained that more material is present between the upper side of the recess and the upper surface of the floor panel, which results in a reinforcement of the respective upper corner of the panel.

According to another preferred embodiment, the floor panel is characterized in that towards said end, and seen in a cross-section transverse to the longitudinal direction of the respective edge, more material is present at the proximal portion or thus the deepest point of the recess. In other words, at such end the recess is made less deep than in the central portion of the edge. Thereby, the material portion situated above the recess, seen in cross-section, becomes shorter and thus will be less easily bendable and deformable.

According to the most preferred embodiment, the floor panel is characterized in that the recess extends up to a distance from said end and thus is not present in the proximity of the end. Hereby, it is obtained that the floor panel will retain its complete strength in the proximity of the end and will not be weakened by the recess.

According to a preferred characteristic, the final recess, thus including the shape prevailing at said end, is formed exclusively by removing material from the floor panel. This offers the advantage that no separate components or materials have to be applied in order to achieve the altered shape in the proximity of the end of the respective edge.

According to an alternative therefor, the recess is less pronouncedly present towards said end, as an at least partial and preferably substantial filling thereof will be provided, preferably by means of an adhered or adhering filling material. Such embodiment in its turn then is advantageous in that the recess, for example, can simply be performed continuously over the entire edge, by which the realization of the recess as such remains simple.

It is clear that the herein above described invention will show its advantages in particular in floor panels in which above the recess concerned only a small thickness of material is present, more particularly in floor panels which are characterized in that the upper side of the recess, at the height of the normal course thereof, is situated, with the exception of a possible inclined part, at a distance from the upper surface of the panel which is less than 1.5 mm and still better is less than 1 mm.

Preferably, said extremity of the respective edge is formed by that end which adjoins the side situated transverse thereto, which, when installing such floor panel, is coupled to the preceding row.

More particularly, this may relate to a floor panel which is characterized in that the floor panel is rectangular, either oblong rectangular, or square; wherein said pair of opposite edges forms a first pair of edges, whereas the remaining two opposite edges form a second pair of edges; wherein on the second pair of edges of the floor panel, coupling parts are provided, of the type allowing that two of such floor panels can be coupled to each other along the respective edges by means of a turning movement, wherein these coupling parts provide for a vertical and a horizontal locking and preferably are made in one piece with the floor panel. As a particular application thereof, this floor panel further is characterized in that the coupling means on the first pair of edges and the second pair of edges are formed such that such panels can be installed via the so-called "fold-down" principle, in other words, that the coupling parts on the second pair of edges allow that the panels, by means of a downward movement, can be coupled to panels of a preceding row, whereas, as a consequence of such turning movements, a locking with an adjacent panel is effected at the first edges as well. Hereby, this relates in the first place to floor panels of which the coupling means on the first pair of edges are designed such that, as a direct consequence of said turning movement, automatically a vertical as well as a horizontal locking is effected at the first pair of edges. However, the invention is also useful in floor panels wherein the coupling means on the first pair of edges will not provide in a vertical locking as a direct consequence of pivoting down the respective floor panel, but where the locking is activated only by presenting thereto a floor panel in the following row. Herein, this last-mentioned floor panel presses laterally on a locking element which is present on the first pair of edges of the floor panel in the preceding row, in such a manner that this locking element is forced into a condition which effects a locking in vertical direction. This last-mentioned technique is also called "side-push" technique.

With oblong panels, said first pair of edges preferably is situated on the short sides, whereas said second pair of edges is situated on the long sides.

Said recess may relate to a seat for a mounted therein separate locking element which, in coupled condition, effects the locking in vertical direction. The separate locking element can be made as an insert in the form of a strip, wherein this separate locking element comprises at least a portion which is laterally movable and in this manner can work in conjunction with a locking portion on an adjoining similar floor panel. Various embodiments are possible and known as such from the state of the art. Preferably, a locking element is applied wherein said laterally movable portion is elastically movable, such that this portion, during coupling of two of such floor panels, is moved laterally against an elastic force in order to then move back into a locking position. The invention is particularly useful for such embodiments, certainly when working with thin floor panels. Such locking element, seen in cross-section, then must be realized with relatively smaller dimensions for being incorporated into the edge of the floor panel. Smaller dimensions, however, will have the consequence that the functioning of the locking element becomes more critical and an accurate joining of the floor panels is recommended. The present invention contributes to that.

According to a preferred embodiment, said separate locking element shows one or a combination of two or more of the following characteristics:

- that the laterally movable portion substantially consists of a pivotable blocking body;
- that the separate locking element is at least composed of, on the one hand, an attachment portion and, on the other hand, a pivotable blocking body;
- that the separate locking element is at least composed of, on the one hand, an attachment portion and, on the other hand, a pivotable blocking body, wherein the blocking body is connected to the attachment portion by means of a hinge portion;
- that the separate locking element substantially consists of a strip of synthetic material;
- that the separate locking element substantially consists of a co-extruded strip, which, seen in cross-section, shows zones of synthetic material with different features, more particular materials of different flexibility;
- that the separate locking element is at least composed of, on the one hand, an attachment portion and, on the other hand, a pivotable blocking body, wherein the blocking body is connected to the attachment portion by means of a hinge portion and wherein the separate locking element substantially consists of a co-extruded strip, which, seen in cross-section, shows zones of synthetic material with different features, more particular materials of different flexibility, wherein the hinge portion is made of a more flexible material than the blocking portion;
- that the separate locking element is provided in a recess, wherein means are provided which retain the locking element in the recess, wherein these means preferably are formed by one or more of the following possibilities: a clamping fit of a portion of the locking element in the recess, a glue connection or the like, a mechanical locking between a portion of the locking element and the wall of the recess.

According to another, already mentioned possibility, said recess is a recess having the purpose of forming a locking edge for a locking element of a panel cooperating therewith.

It is clear that in certain embodiments the inventive idea can also be applied to two opposite edges of a floor panels. More particularly, such floor panel then will be characterized in that on both said edges a recess is present, which both show the characteristic that the shape and/or the position of the recess in the proximity of at least one end of the respective edge is different in respect to a portion of the recess, which portion is situated more proximally in respect to the longitudinal direction of the edge, wherein the recess on one of the edges forms a seat for a separate locking element, whereas the recess on the other edge has the purpose of forming a locking edge for a locking element of an adjacent similar panel.

According to another subordinate characteristic of the invention, said coupling parts comprise hook-shaped parts, in the form of an upwardly directed locking part, which is provided on a first lip on a first of said two edges, and a downwardly directed locking part, which is provided on a second lip on the second of said two edges, respectively, wherein these hook-shaped parts effect a locking in horizontal direction. Herein is noted that the locking parts, which provide for the locking in vertical direction, can be provided on the hook-shaped parts at different locations. Preferably, however, they are respectively positioned at the distal end of the hook-shaped part, which is provided with said downwardly directed locking part, and the proximal portion of the hook-shaped part, which is provided with the upwardly directed locking part. This preferred positioning shows its advantages best in thin panels and/or panels with a limited material strength, for example, due to the fact that the material is relatively supple and deformable, such as with soft PVC, or due to the fact that the material can split in the horizontal plane, such as with MDF and HDF.

Although the invention can be employed in floor panels of any thickness, it is, as aforementioned, primarily useful when applied in thin floor panels, more particularly floor panels having a thickness of less than 6 mm, and more specifically less than 5 mm. It is clear that this relates in the first place to decorative floor panels, thus, with a decorative upper side, for forming a floor covering on an existing supporting floor, and more particularly for forming a floating floor covering.

The invention shows its advantages best in floor panels which substantially consist of synthetic material or which comprise at least a substrate on the basis of synthetic material, and even more in floor panels of the supple type. In such floor panels of supple material, there is in fact a considerable risk that deformations, possibly with permanent damages, will occur at the upper edges of the floor panels as a result of frictional and/or torsional forces which occur or may occur between the upper edges during coupling of the floor panels. By applying the technique of the invention, stronger corner zones can be created on one or more of the corners than compared with the case that the recess simply is continued, with the result that deformations are excluded or minimized.

More particularly, this is particularly advantageous in vinyl panels, in particular so-called vinyl tiles, and in particular in panels of the so-called LVT type ("Luxury Vinyl Tile" or VCT type ("Vinyl Composite Tile", also called "Vinyl Composition Tile").

Such synthetic material panel, and in particular supple synthetic material panel, and more particularly such vinyl tile, preferably shows one of the following characteristics:

- the floor panel is substantially composed of a substrate and a top layer, wherein the substrate and/or the top layer as such also may or may not be composed of a plurality of layers;
- herein, the top layer comprises at least a decorative layer, preferably in the form of a print preferably provided on a foil or film;
- the top layer comprises at least a translucent or transparent wear layer;
- the floor panel, or at least the substrate of the floor panel, is substantially composed of a thermoplastic material, preferably a soft thermoplastic material;
- the floor panel, or at least the substrate of the floor panel, is substantially composed of polyvinyl chloride, more particularly of soft polyvinyl chloride, more particularly provided with plasticizers or the like; a composition "substantially" on the basis of PVC must be interpreted in a broad sense, as a large number of additives, for example, fillers, can be employed in PVC floors;
- the floor panel comprises at least one reinforcing layer, preferably formed of fibers, more particularly reinforcing fibers, such as glass fibers.

Another important application of the invention is in panels comprising a substrate, which substantially, in other words, for the majority of its thickness, is formed of mutually consolidated layers of carriers impregnated with thermo-hardening resin. As a result of the joining of two of such panels by a downward movement, it can happen that frictional forces or undesired interactions occur at the upper edges, such as edges becoming situated on top of each other, with the consequence that a delamination may occur in the uppermost edge region. It is clear that by applying the present invention, a better guiding of the upper edges along each other or a more solid top zone can be created at the height of possible recesses, which limits the risk of deformations and delamination. Still more particularly, this is advantageous in floor panels which are characterized in that the substrate comprises at least two carriers and that at least these two carriers and preferably all carriers of the substrate are formed of a layer of paper fibers, which layers, in un-resinated condition, have a density of less than 750 kg per cubic meter.

Such floor panels consisting of consolidated layers of carriers impregnated with thermo-hardening resin can be made in any thickness, however, it is clear that the invention is particularly useful for thin panels, for example, of less than 5 mm and more specifically 4 mm or less.

Splitting or delamination as a result of joining floor panels via a downward movement is also realistic with floor panels having a substrate of wood fiberboard, more particularly a substrate consisting of MDF (Medium Density Fiberboard) or HDF (High Density Fiberboard), and in particular with laminate, more particularly DPL (Direct Pressure Laminate). It is clear that the invention then can also be useful for such panels.

Although the invention is primarily advantageous for floor panels which can be coupled to each other by means of a downward movement, according to a deviating variant of the invention it is also possible to apply it to floor panels which are intended for being connected to each other in another manner, such inasfar as a recess is present on one edge, which recess, in accordance with the invention, is modified in the proximity of the edge.

The present invention also relates to a covering, more particularly a floor covering, with the characteristic that it is composed of panels, more particularly floor panels, as described herein above.

In addition, the invention relates to a method for manufacturing panels, more particularly floor panels, as described herein above, wherein this method comprises at least the following steps:

forming the panel, more particularly floor panel;

providing profiled parts at the height of one or more edges of the floor panel, wherein at least one recess is formed in an edge, either as a seat for a separate locking element, or as a recess for forming a locking edge;

characterized in that the recess is realized by means of a rotating machining tool, more particularly a milling cutter or a saw, wherein this tool and the panel are displaced relatively in mutual respect in the longitudinal direction of the edge, wherein in the proximity of the end, the ends, respectively, where the recess is present at least less pronouncedly, the cutting tool is brought into a more retracted position than when forming the central portion. This allows a smooth manufacture. According to a preferred embodiment, for the rotating cutting tool a milling cutter is applied having a diameter of less than 15 cm, and still better having a diameter in the order of magnitude of 10 cm or less. Hereby is obtained that, seen in the longitudinal direction of the edge, the length of the transition zone between the area where the recess is present and the area where the recess is not present or is modified, can be kept limited.

Herein above, by "separate locking element" a locking element is intended which is produced separately and is provided in the panel, either at the factory or by the user or installer. Herein, the separate locking element can be provided loosely in a recess or the like, provided for this purpose, on the floor panel or can be fixedly attached to the floor panel, for example, by mechanically locking the locking element in an adapted recess, or also by gluing it into a recess provided for this purpose, or by attaching it to the panel in any other manner. Preferably, the separate locking element is provided at the factory, preferably by machine. However, it is not excluded that, without leaving the scope of the present invention, the separate locking element may be provided by the user or installer.

As already stated herein above, the present invention shows its advantages in particular when being applied in floor panels which are substantially made of supple or soft synthetic material, or, in other words, in supple panels.

By supple panels, panels are meant, which panels, when, in the case of a rectangular panel, for example, with a width of less than 50 centimeters, they are fixedly clamped on one of both short sides of the panel and thereby project over a length of 100 centimeters and are not supported, will bend under the influence of their own weight, wherein this bending, at the height of the free extremity, is minimum 10 centimeters in respect to the clamped extremity. For this bending, a bending time of 10 seconds is taken into account, and wherein the panel starts from a flat horizontal position.

According to an independent second aspect, the invention relates to floor panels which specifically are of the type which substantially consists of synthetic material and is of the supple type, in other words, consists of supple synthetic material, sometimes also called "resilient floor panels", amongst which the aforementioned LVT panels resort as a typical, however, not limiting example. According to this second aspect, a floor panel of the type mentioned in the preceding sentence is intended, which, on at least one pair of opposite edges, comprises coupling parts, which allow coupling two of such floor panels to each other by means of a downward movement, wherein the risk of temporary and/or permanent deformations in the edge region, amongst others, as a result of joining, is minimized without thereby still necessitating that the shape and/or position of the recess for the locking element applied therein has to be altered along the edge, in other words, without the necessity of applying the first aspect of the invention.

This second aspect provides for a plurality of possibilities, which will be explained and illustrated below in the introduction as well as further in the detailed description.

According to a first possibility, the second aspect provides for a floor panel for forming a floor covering, wherein this floor panel substantially consists of synthetic material and is of the supple type;

wherein this floor panel, on at least one pair of opposite edges, comprises coupling parts, which allow joining two of such floor panels by means of a downward movement of one floor panel in respect to the other floor panel, wherein these coupling parts allow a locking in a first direction perpendicular to the plane of the floor panels as well as in a second direction perpendicular to the respective edge and in the plane of the floor panels;

wherein the coupling parts comprise a first locking system for the locking in said first direction and a second locking system for the locking in said second direction;

wherein the second locking system substantially is formed of an upwardly directed lower hook-shaped part situated on an edge, as well as of a downwardly directed upper hook-shaped part situated on the opposite edge, which hook-shaped parts can be engaged behind each other by said downward movement;

wherein the lower hook-shaped part consists of a lip which extends laterally from the lower edge of the panel and which is provided with an upwardly directed locking element with a locking surface, whereas the upper hook-shaped part consists of a lip which extends laterally from the upper edge of the panel and which is provided with a downwardly directed locking element with a locking surface;

wherein said first locking system comprises a separate locking element;

wherein this locking element is provided in a longitudinal recess which is present on the respective edge at a distance underneath the upper surface, more particularly the upper side, and is separated from the upper surface by a lip-shaped part;

wherein this lip-shaped part, seen in cross-section, comprises a proximal end and a distal end and wherein the distal end defines an upper edge;

wherein the lip-shaped part, near the proximal end, has a thickness, herein below denominated proximal thickness, wherein this proximal thickness is formed by a distance perpendicular to the upper surface, measured from the upper surface to a tangent point determined by a line at an angle of 60° with said upper surface, which is directed downward in proximal direction and which is tangential to said recess; and wherein the lip-shaped part, seen in cross-section, has a horizontal length which is formed by the horizontal distance between the most distal end of the lip-shaped part and the most proximal point of said recess;

characterized in that the floor panel combines the following two features:

on the one hand, that said locking surfaces are configured such that in the coupled condition, on a location where they contact each other, they form an angle different from 90 degrees with the plane of the floor panel;

and, on the other hand, that said lip-shaped part shows at least one of the following features or a combination of any two or three of the following features, or all four of the following features:

the ratio of said proximal thickness to said horizontal distance is larger than 0.75;

said recess is situated over its entire depth, possibly with the exception of the first 10% of its depth, below an imaginary line which extends through said upper edge and is inwardly sloping downward over an angle of 36 degrees;

said horizontal length, or thus the depth of the recess, is less than 2.4 mm and still better less than 2.2 mm;

said horizontal length is smaller than 0.4 times the overall thickness of the floor panel.

According to a second possibility, the second aspect provides for a floor panel for forming a floor covering, wherein this floor panel substantially consists of synthetic material and is of the supple type;

wherein the floor panel, on at least one pair of opposite edges, comprises coupling parts which allow joining two of such floor panels by means of a downward movement of one floor panel in respect to the other floor panel, wherein these coupling parts allow a locking in a first direction perpendicular to the plane of the floor panels as well as in a second direction perpendicular to the respective edge and in the plane of the floor panels;

wherein the coupling parts comprise a first locking system for the locking in said first direction and a second locking system for the locking in said second direction;

wherein the second locking system substantially is formed of an upwardly directed lower hook-shaped part situated on an edge, as well as of a downwardly directed upper hook-shaped part situated on the opposite edge, which hook-shaped parts, when interconnecting two such floor panels, can be engaged behind each other by said downward movement;

wherein the lower hook-shaped part consists of a lip which extends laterally from the lower edge of the panel and which is provided with an upwardly directed locking element with a locking surface, whereas the upper hook-shaped part consists of a lip which extends laterally from the upper edge of the panel and which is provided with a downwardly directed locking element with a locking surface;

wherein said first locking system comprises a separate locking element;

wherein this locking element is provided in a longitudinal recess which is present on the respective edge at a distance underneath the upper surface, more particularly the upper side, and is separated from the upper surface by a lip-shaped part;

wherein this lip-shaped part, seen in cross-section, comprises a proximal end and a distal end and wherein the distal end defines an upper edge;

wherein the lip-shaped part, near the proximal end, has a thickness, herein below denominated proximal thickness, wherein this proximal thickness is formed by a distance perpendicular to the upper surface, measured from the upper surface to a tangent point determined by a line at an angle of 60° with said upper surface, which is directed downward in proximal direction and which is tangential to said recess; and wherein the lip-shaped part, seen in cross-section, has a horizontal length which is formed by the horizontal distance between the most distal end of the lip-shaped part and the most proximal point of said recess;

characterized in that the floor panel combines the following two features:

on the one hand, that the recess is bordered by a bottom wall consisting at least of a first portion and a second portion, of which the second portion is situated more inwardly than the first portion and also is situated lower than the first portion;

and, on the other hand, that said lip-shaped part shows at least one of the following features or a combination of any two or three of the following features, or all four of the following features:

the ratio of said proximal thickness to said horizontal length is larger than 0.75;

said recess is situated over its entire depth, possibly with the exception of the first 10% of its depth, below an imaginary line which extends through said upper edge (59) and is inwardly sloping downward over an angle of 36 degrees;

said horizontal length, or thus the depth of the recess, is less than 2.4 mm and still better less than 2.2 mm;

said horizontal length is smaller than 0.4 times the overall thickness of the floor panel.

According to a third possibility, the second aspect provides for a floor panel for forming a floor covering, wherein this floor panel substantially consists of synthetic material and is of the supple type;

wherein the floor panel, on at least one pair of opposite edges, comprises coupling parts which allow joining two of such floor panels by means of a downward movement of one floor panel in respect to the other floor panel, wherein these coupling parts allow a locking in a first direction perpendicular to the plane of the floor panels as well as in a second direction perpendicular to the respective edge and in the plane of the floor panels;

wherein the coupling parts comprise a first locking system for the locking in said first direction and a second locking system for the locking in said second direction;

wherein the second locking system substantially is formed of an upwardly directed lower hook-shaped part situated on an edge, as well as of a downwardly directed upper hook-shaped part situated on the opposite edge, which hook-shaped parts, when interconnecting two such floor panels, can be engaged behind each other by said downward movement;

wherein the lower hook-shaped part consists of a lip which extends laterally from the lower edge of the panel and which is provided with an upwardly directed locking element with a locking surface, whereas the upper hook-shaped part consists of a lip which extends laterally from the upper edge of the panel and which is provided with a downwardly directed locking element with a locking surface;

wherein the lower hook-shaped part comprises an engagement portion for the upper hook-shaped part;

wherein said first locking system comprises a separate locking element;

wherein this locking element is provided in a longitudinal recess which is present on the respective edge at a distance underneath the upper surface, more particularly the upper side, and is separated from the upper surface by a lip-shaped part;

wherein this lip-shaped part, seen in cross-section, comprises a proximal end and a distal end and wherein the distal end defines an upper edge;

wherein the lip-shaped part, near the proximal end, has a thickness, herein below denominated proximal thickness, wherein this proximal thickness is formed by a distance perpendicular to the upper surface, measured from the upper surface to a tangent point determined by a line at an angle of 60° with said upper surface, which is directed downward in proximal direction and which is tangential to said recess; and wherein the lip-shaped part, seen in cross-section, has a horizontal length which is formed by the horizontal distance between the most distal end of the lip-shaped part and the most proximal point of said recess;

characterized in that said engagement portion has a length which is greater than or equal to 1.2 times the aforementioned horizontal length, however, is smaller than or equal to 1.8 times this horizontal length.

According to a particular embodiment of the third possibility, the floor panel is characterized in that it also shows one or more of the following features:

the ratio of said proximal thickness to said horizontal length is larger than 0.75;

said recess is situated over its entire depth, possibly with the exception of the first 10% of its depth, below an imaginary line which extends through said upper edge and is inwardly sloping downward over an angle of 36 degrees;

said horizontal length, or thus the depth of the recess, is less than 2.4 mm and still better less than 2.2 mm;

said horizontal length is smaller than 0.4 times the overall thickness of the floor panel;

said locking surfaces are configured such that they, in coupled condition, at a location where they contact each other, form an angle with the plane of the floor panel which is different from 90 degrees;

the recess is bordered by a bottom wall which consists at least of a first portion and a second portion, of which the second portion is situated more inwardly than the first portion and is also situated lower than the first portion.

According to a fourth possibility, the second aspect provides for a floor panel for forming a floor covering, wherein this floor panel substantially consists of synthetic material and is of the supple type;

wherein the floor panel, on at least one pair of opposite edges, comprises coupling parts which allow joining two of such floor panels by means of a downward movement of one floor panel in respect to the other floor panel, wherein these coupling parts allow a locking in a first direction perpendicular to the plane of the floor panels as well as in a second direction perpendicular to the respective edge and in the plane of the floor panels;

wherein the coupling parts comprise a first locking system for the locking in said first direction and a second locking system for the locking in said second direction;

wherein the second locking system substantially is formed of an upwardly directed lower hook-shaped part situated on an edge, as well as of a downwardly directed upper hook-shaped part situated on the opposite edge, which hook-shaped parts, when interconnecting two such floor panels, can be engaged behind each other by said downward movement;

wherein the lower hook-shaped part consists of a lip which extends laterally from the lower edge of the panel and which is provided with an upwardly directed locking element with a locking surface, whereas the upper hook-shaped part consists of a lip which extends laterally from the upper edge of the panel and which is provided with a downwardly directed locking element with a locking surface;

wherein the lower hook-shaped part comprises an engagement portion for the upper hook-shaped part;

wherein said first locking system comprises a separate locking element;

wherein this locking element is provided in a longitudinal recess which is present on the respective edge at a distance underneath the upper surface and is separated from the upper surface by a lip-shaped part; and wherein this lip-shaped part, seen in cross-section, comprises a proximal end and a distal end;

characterized in that said lip-shaped part, at the distal end thereof, has a global thickness which is larger than 15% of the overall thickness of the floor panel, whereas the smallest thickness of said lower lip, at the location of the engagement portion thereof, is larger than 30% of the overall thickness of the floor panel.

According to a preferred embodiment of the fourth possibility of the second aspect, a floor panel is provided wherein the lip-shaped part, next to the proximal end, has a thickness, herein below denominated proximal thickness, wherein this proximal thickness is formed by a distance perpendicular to the upper surface, measured from the upper surface to a tangent point determined by a line at an angle of 60° with said upper surface, which is directed downward in proximal direction and which is tangential to said recess; and wherein the lip-shaped part, seen in cross-section, has a horizontal length which is formed by the horizontal distance between the most distal end of the lip-shaped part and the most proximal point of said recess;

characterized in that the floor panel also shows one or more of the following features:

the ratio of said proximal thickness to said horizontal length is larger than 0.75;

said recess is situated over its entire depth, possibly with the exception of the first 10% of its depth, below an imaginary line which extends through said upper edge and is inwardly sloping downward over an angle of 36 degrees;

said horizontal length, or thus the depth of the recess, is less than 2.4 mm and still better less than 2.2 mm;

said horizontal length is smaller than 0.4 times the overall thickness of the floor panel;

said locking surfaces are configured such that they, in coupled condition, at a location where they contact each other, form an angle with the plane of the floor panel which is different from 90 degrees;

the recess is bordered by a bottom wall which consists at least of a first portion and a second portion, of which the second portion is situated more inwardly than the first portion and is also situated lower than the first portion;

the lower hook-shaped part comprises an engagement portion for the upper hook-shaped part, wherein said engagement portion has a length which is greater than or equal to 1.2 times the aforementioned horizontal length, however, is smaller than or equal to 1.8 times this horizontal length.

It is evident that the herein above-mentioned possibilities can be combined at choice, in as far as they do not comprise any contradictory characteristics.

According to preferred embodiments of the floor panel, which are realized according to the second aspect, irrespective whether herein the characteristics of the first and/or second and/or third and/or fourth possibility are applied, the floor panel is characterized by one or more of the following characteristics:

that said recess extends with a uniform cross-section throughout the entire respective edge; thanks to the characteristics of the second aspect, the corner zones are less critical and the recess can be made continuous without problems;

that the floor panel is rectangular, either oblong rectangular or square; wherein said pair of opposite edges forms a first pair of edges, whereas the remaining two opposite edges form a second pair of edges; wherein on the second pair of edges of the floor panel, coupling parts are provided, of the type which allows coupling two of such floor panels to each other along the respective edges by means of a turning movement, wherein these coupling parts provide for a vertical and a horizontal locking and preferably are made in one piece with the floor panel;

that, in combination with the preceding paragraph, the coupling means on the first pair of edges and the second pair of edges are formed such that such panels can be installed via the so-called "fold-down" principle, in other words, that the coupling parts on the second pair of edges allow coupling the panels, via a downward turning movement, to panels of a preceding row, whereas as a result of such turning movements a locking on the first edges with an adjacent panel is effected as well;

that the separate locking element is made as an insert in the form of a strip, wherein this separate locking element comprises at least a portion which is laterally movable and in this manner can cooperate with a locking portion on an adjacent similar floor panel;

that, in combination with the preceding paragraph, said laterally movable portion is elastically movable, such that this portion, during coupling of two such floor panels, is moved sideways, against an elastic force, in order to then come back into a locking position;

that the locking element is at least composed of an attachment portion and a pivotable blocking body;

that the locking element is made in the form of a displaceable, more particularly slidable, tongue;

that the floor panel has a thickness of less than 6 mm, and more specifically in the order of magnitude of 5 mm or even less than 5 mm; the invention in fact aims at a composition which allows working with thin thicknesses, without the occurrence of substantial deformations;

that the floor panel, or at least the substrate of the floor panel, substantially is composed of a thermoplastic material, preferably of a soft thermoplastic material;

that the floor panel substantially is composed of a substrate and a top layer;

that the floor panel, or at least the substrate of the floor panel, substantially is composed of polyvinyl chloride, more particularly of soft polyvinyl chloride, and still more particularly has a substrate which comprises plasticizers;

that the floor panel is a vinyl panel, more particularly a so-called vinyl tile, and in particular a panel of the so-called LVT type ("Luxury Vinyl Tile") or VCT type ("Vinyl Composite Tile", also called "Vinyl Composition Tile");

that the floor panel, or at least the substrate of the floor panel, substantially is formed on the basis of polyurethane or polypropylene;

that it comprises a substrate which is provided with fillers, such as chalk;

that it is provided with a reinforcement layer.

BRIEF DESCRIPTION OF THE DRAWINGS

With the intention of better showing the characteristics of the invention, herein below, as an example without any limitative character, some preferred embodiments are described, with reference to the accompanying drawings, wherein.

DETAILED DESCRIPTION OF PREFERRED EMBODIMENTS OF THE DISCLOSURE

In FIGS. 1 to 7, an embodiment is represented of a panel 1 according to the invention, which is realized as a floor panel.

In the represented example, the panel 1 is realized as an oblong rectangular strip and thus comprises two pairs of opposite edges 2-3 and 4-5, which in this case form the long and the short sides of the panel, respectively. Herein below, the pair 4-5 will be denominated the first pair of edges, in consideration of the fact that the invention in the represented example is applied to this pair, whereas the edges 2-3 then will be denominated the "second pair".

Figure 1:
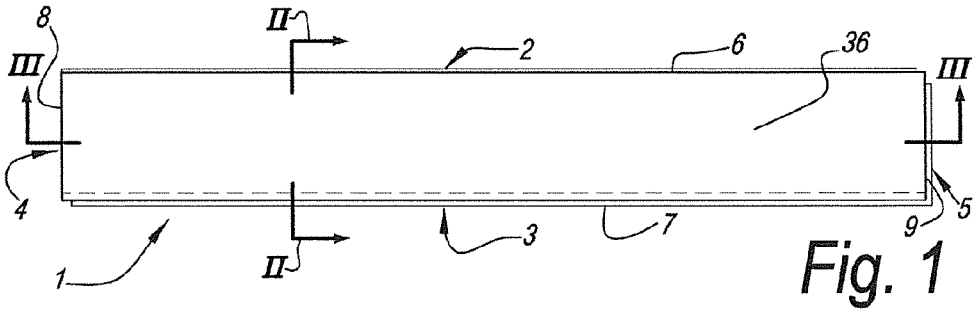
FIG. 1 represents a panel according to the invention.
Figure 2:
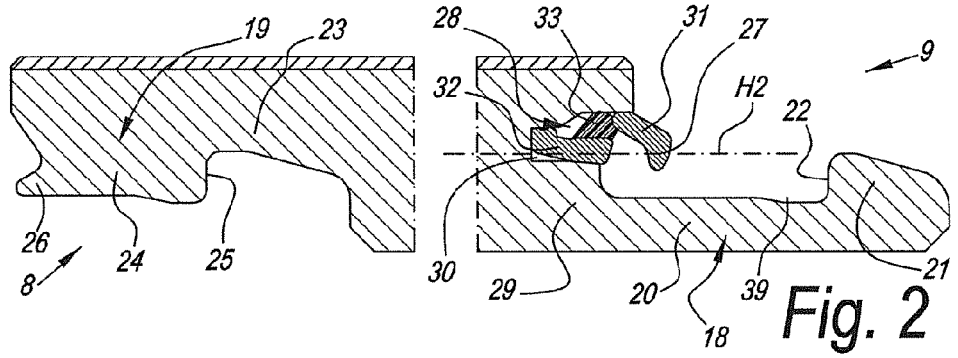
FIGS. 2 and 3, at a larger scale, respectively represent a cross-section according to the lines II-II and III-III represented in FIG. 1.
Figure 3:
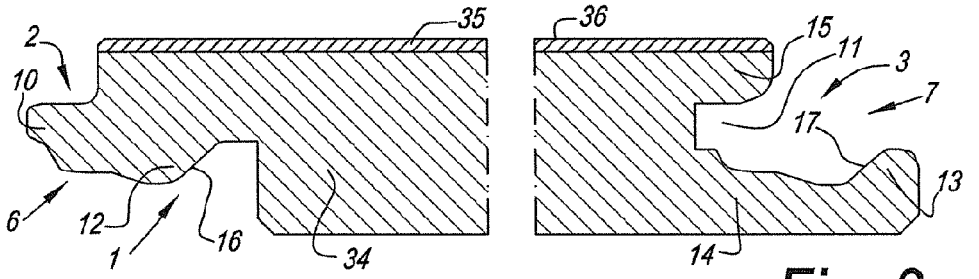

As is represented more detailed in FIGS. 2 and 3, both pairs of opposite edges 2-3 and 4-5 comprise coupling parts 6-7, 8-9, respectively, which allow that a plurality of such panels 1 mutually can be coupled to each other.

Figure 4:
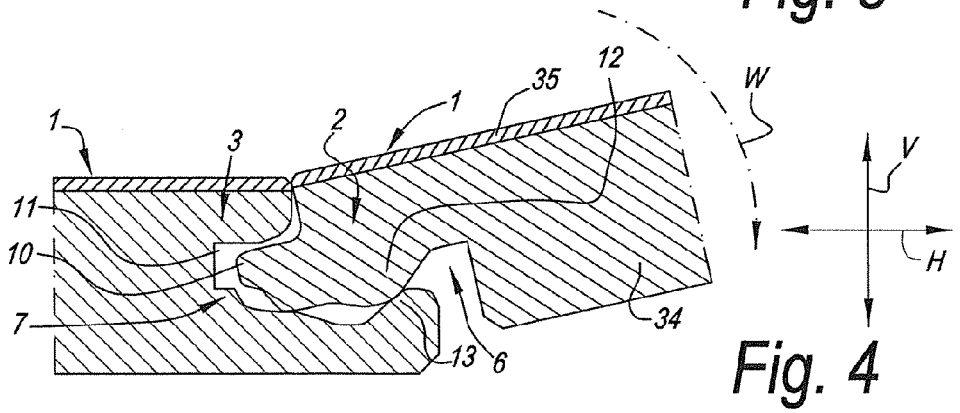
FIG. 4 represents how two floor panels can be coupled together at the edges of FIG. 3.

As specifically represented in FIGS. 3 and 4, the coupling parts 6-7 on the second pair of opposite edges 2-3 are configured such that two of such panels can be coupled to each other in a locking manner at these edges 2-3 by means of a turning movement W. Herein, the coupling parts 6-7 form a first locking system which effects a locking in the plane of the panels 1 and perpendicular to said edges 2-3, thus, in this case, in the horizontal direction H, as well as a second locking system which effects a locking transverse to the plane of the panels 1, in this case, thus, in the vertical V or the first direction mentioned in the introduction. To this aim, the coupling parts 6-7 are constructed as a tongue 10 and a groove 11 which provide for the vertical locking and comprise locking parts 12-13, which, in the coupled condition, prevent the drifting apart of tongue and groove.

Herein, it is preferred that, as represented, the groove 11 is bordered by a lower lip 14 and an upper lip 15 and that the locking parts 12 and 13 are made in the form of mutually cooperating protrusions on the underside of the tongue 10 and on the upper side of the lower lip 14, respectively. The cooperation is performed by means of locking surfaces 16 and 17 provided for this purpose. As also represented, it is also preferred that the lower lip 14 extends laterally beyond the distal end of the upper lip 15, more particularly in such a manner that the locking surface 17 is located entirely in that portion of the lower lip 14 which is situated outward of the upper lip 15.

Figure 5:
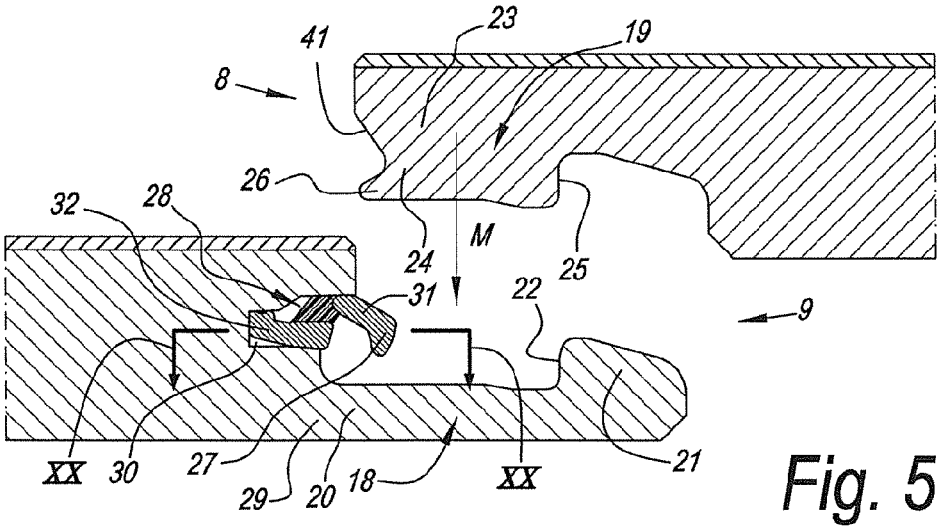
FIGS. 5 to 7 represent how such floor panels can be coupled at the edges represented in FIG. 2.
Figure 6:
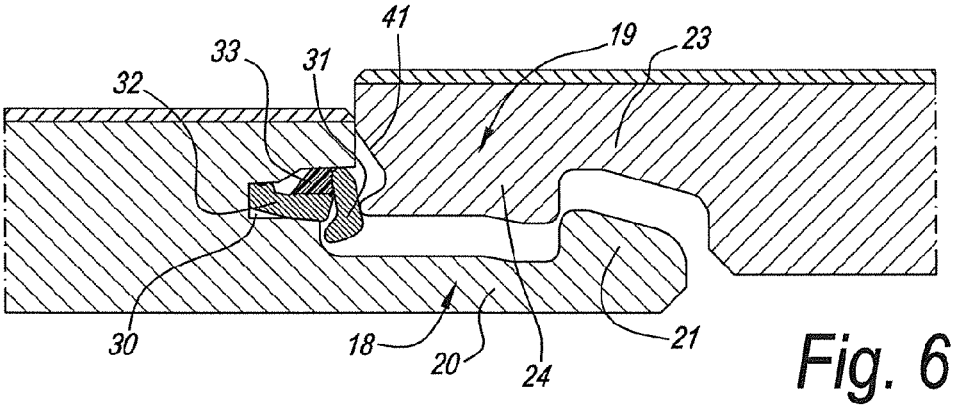
Figure 7:
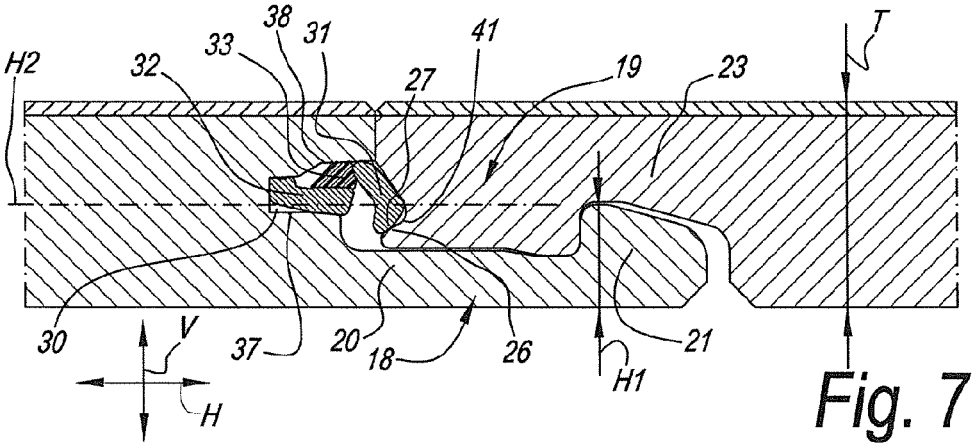

As schematically represented in FIGS. 5 to 7, the coupling parts 8-9 on the first pair of opposite edges 4-5 are configured such that two of such panels 1 can be coupled to each other by means of a downward movement M of one panel in respect to the other. This downward movement M will be explained below in more detail.

As is clearly illustrated in FIG. 7, the coupling parts 8-9 hereby form a first locking system which effects a locking transverse to the plane of the panels 1, in this case, thus, in the vertical direction V, as well as a second locking system which effects a locking in the plane of the panels 1 and perpendicularly to said edges 4-5, thus, in this case, in the horizontal direction H.

The second locking system or the integrated mechanical locking means are substantially formed of an upward-directed lower hook-shaped part 18, which is situated on the edge 5, as well as a downward-directed upper hook-shaped part 19, which is situated on the opposite edge 4, which hook-shaped parts can be engaged behind each other by said downward movement M. The lower hook-shaped part 18 consists of a lip 20 which extends laterally from the lower edge of the panel 1 and which is provided with an upward-directed locking element 21 with a locking surface 22, whereas the upper hook-shaped part 19 consists of a lip 23 which extends laterally from the upper edge of the panel 1 and which is provided with a downward-directed locking element 24 with a locking surface 25.

The first locking system of the edges 4-5 on the short sides is formed by locking parts or locking portions 26-27. In the represented embodiment, the coupling parts 8-9 for this purpose comprise a separate element or separate locking element 28, which, in coupled condition, as represented in FIG. 7, provides at least for a locking in the vertical direction V. In the example, the separate locking element 28 is situated in the female coupling part 9, more particularly in the proximity of the proximal end 29 of the lower hook-shaped part 18.

As represented in FIGS. 5 to 8, the separate locking element 28 is made as an insert in the form of a strip and is provided in a recess 30 in one of the edges 5. Herein, the strip preferably extends over a considerable part of the edge on which it is provided, such preferably with a uniform cross-section. In this case, the separate locking element 28 comprises a pivotable blocking body 31, which, as represented, amongst others, in FIG. 6, is laterally movable and consequently can cooperate with the locking portion 26 of an adjacent floor panel 1. The blocking body 31 is elastically movable and, towards the end of the downward movement M, arrives in a locking position, as represented in FIG. 7. In the locking position, the blocking body 31 comes into contact with the locking portion 26 of an adjacent floor panel 1. This contact results in said locking in the direction V.

The separate locking element 28 represented here further also comprises an attachment portion 32, wherein the blocking body 31 is connected to the attachment portion 32 via a hinge portion 33. In this case, a clamping fit of the attachment portion 32 in the recess 30 is applied. According to an alternative, the attachment portion 32 is connected to the panel 1 at least in that it is glued into such recess 30.

In the examples, the separate locking element consists of a coextruded strip, which, seen in the plane of the FIGS. 5 to 8, comprises zones of synthetic material with different features, wherein the zone of the hinge portion 33 is made of a more flexible material than the zone of the blocking body 31 and the zone of the attachment portion 32.

It is noted that the coupling parts 8-9 substantially can also be considered a tongue and groove coupling, wherein the locking part 26 functions as a tongue, whereas the groove in which this tongue becomes seated, is defined by the locking part 27, which functions as an upper lip, and the first hook-shaped part 18, which functions as a lower lip.

It is noted that the space between the vertically active locking part 27 and the horizontally active locking element 21 functions as a female part, whereas the locking element 24 is made as a male part which fits into the female part.

The panel 1 of the examples is substantially formed on the basis of soft polyvinyl chloride (PVC). More specifically, it comprises a substrate which is realized on the basis of soft PVC, which substrate is indicated in the figures by reference 34. In these figures, this substrate is schematically depicted as a single layer. In reality, this may be a single layer as well as a plurality of layers, which do not all have to consist of PVC. On the substrate, usually a top layer 35 is provided, which, in the figures, is also represented by a single layer only, however, in reality may also consist of a plurality of layers. The top layer 35 at least aims at providing a decorative upper side 36 on the panel 1, preferably in the form of a printed decor, and, at least in the case of a floor panel, at providing a wear-resistant surface.

As indicated in FIG. 7, the panels have an overall thickness T. The thickness T preferably has a value of less than 6 mm and still better of less than 5 mm. In particular with such small thicknesses the invention shows its advantages, which, however, does not exclude that the invention can also be applied with panels of larger thicknesses.

The example of the figures shows the characteristic that the upward-directed locking part 21, seen in cross-section, extends over a height H1 which is at least 24% of the overall thickness T of the floor panel 1. Herein, the highest point of this upward-directed locking part 21 is situated in a horizontal plane H2 located between the lower surface 37 and the upper surface 38 of the recess 30 and/or in a horizontal plane H2 intersecting the blocking body 31, in this case both in coupled condition and in not-coupled condition. Moreover, the horizontal plane H2 extends above the locking portion 26 with which the blocking body 31 works in conjunction. However, completely different configurations and proportions are not excluded.

It is noted that said coupling parts, 6-7 as well as 8-9, as represented, with the exception of said separate locking element, preferably are formed in one piece of the material of the actual panel 1, more particularly of the substrate material. As a consequence thereof, the coupling parts as such substantially consist of soft PVC, too. It is noted that these portions of the coupling parts 6-7 and 8-9 preferably are formed by means of a machine treatment, more particularly milling treatments. Milling techniques which allow providing locking coupling parts on the edges of panels are known, amongst others, from WO 97/47834 . Thus, by means of choosing appropriate milling cutters and an appropriate adjustment thereof, suitable profiles, for example, as are represented in the figures, can be realized.

Figure 8:
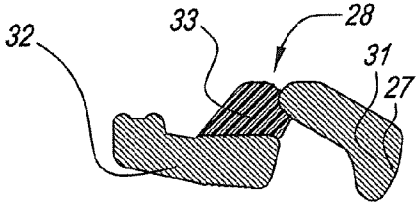
FIG. 8, at a larger scale, represents the separate locking element which is provided in the pair of edges of FIG. 2.

In FIG. 8, the locking element as such is represented in free condition.

Figure 9:
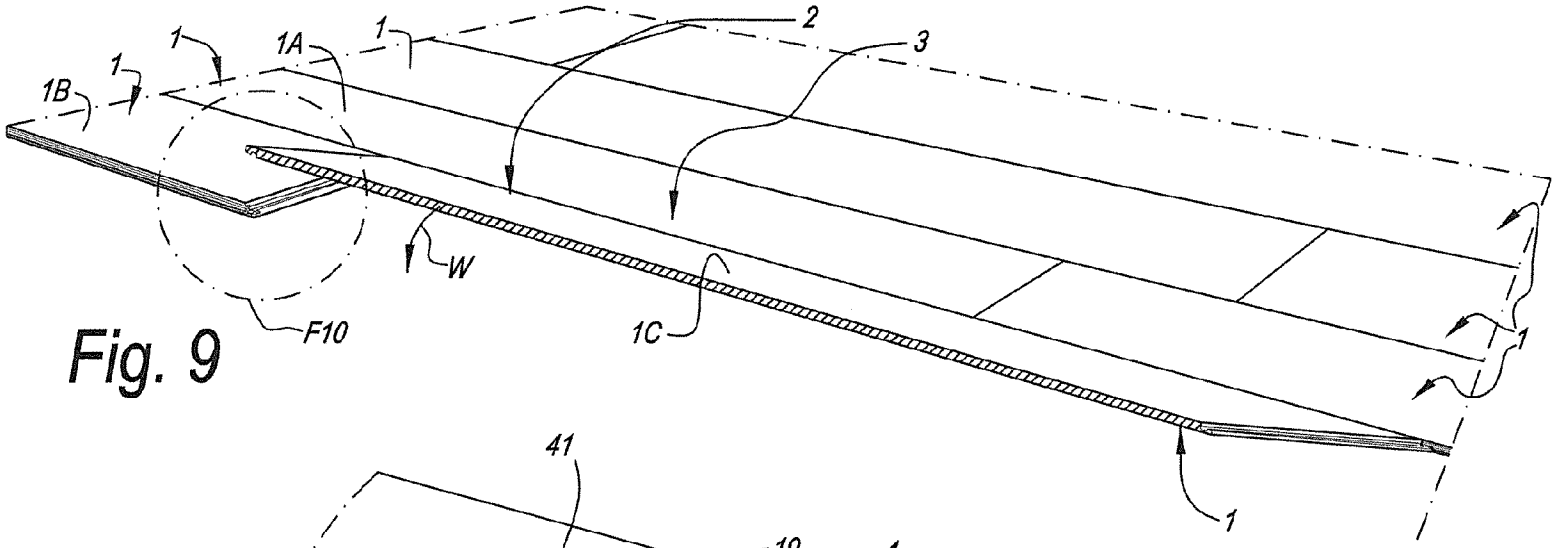
FIGS. 9 and 10 represent in perspective how the long and the short edges of the floor panel of FIG. 1 can be coupled to similar floor panels, wherein FIG. 10 at a larger scale shows a view of the area indicated by F10 in FIG. 9.
Figure 10:
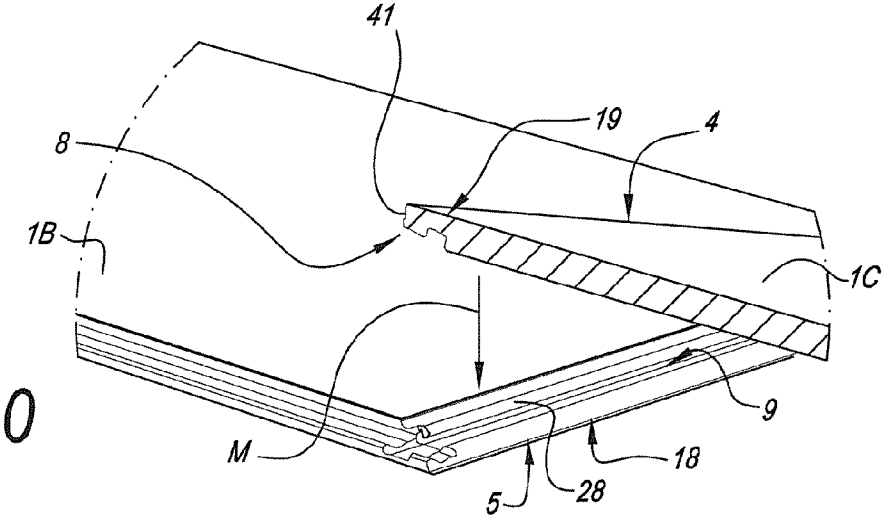

In FIGS. 9 and 10 is represented schematically how the panels 1 can be installed. In order to illustrate the method, a number of the panels 1 are indicated by references 1A, 1B and 1C for extra distinction. The panels 1 are installed row by row and coupled to each other. For obtaining that the panels 1-1A-1B-1C are coupled on the edges 2-3 as well as 4-5, the method comprises at least the following steps:

installing a first panel 1A which is intended for forming part of a first row of panels;

coupling a second panel 1B to said first panel 1A, such on the edges 2-3, wherein this second panel 1B is intended for forming part of a second row following said first row of panels;

coupling, in the second row, a third panel 1C to said first panel 1B as well as to the first panel 1A, wherein the third panel 1C is coupled to the first panel 1A by means of a turning movement, wherein the third panel 1 C, from an upward-turned position, is brought into substantially the same plane as the first and second panels, whereas, as a consequence of this movement and the downward movement created thereby, the hook-shaped parts 18-19 between the third and second panel engage in each other.

It is clear that usually, between the installation of the first panel 1A and the coupling thereto of the second panel 1B, first also all further panels of the row in which the first panel 1A is situated, are installed. Coupling the second panel 1B to the first panel 1A of course is also performed by connecting the panel 1B, at its edge 2, by means of a turning movement W, as represented in FIG. 4, to the edge 3 of the first panel 1A and possible other panels of the row of the panel 1A.

When connecting the panel 1C to the panel 1A, also a turning movement W, as in FIG. 4, is applied. Herein, on the short edges 4-5 a downward movement M is performed, by which the coupling parts 8 and 9 are joined together.

By this downward movement M, in a very broad sense any form of movement is intended wherein, in a cross-section as seen in FIGS. 5 to 7, the one panel is put down from a higher position in respect to the other. This movement M does not necessarily have to be a straight-lined movement, and during this movement temporarily deformations may occur in the panels and more particularly in the hook-shaped parts 18 and 19.

It is also noted that the examples of the figures also illustrate that said lip 20 of the lower hook-shaped part 18 diminishes in thickness from the middle of the floor panel 1 towards the free extremity of this lip, at least over a portion of this lip 20. In the example, this feature is obtained in that the upper side of the lip 20 has a stepped downward contour and thus a deeper-situated portion 39 of this lip 20 is formed, in this case just in front of the upward-directed locking portion 21.

Figure 11:
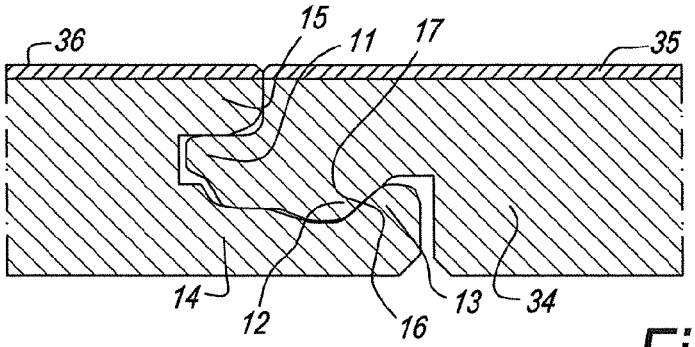
FIG. 11, for clarity's sake, represents the coupling parts from FIG. 4 in completely coupled condition.

In FIG. 11, for clarity's sake the edges 2-3 are represented again in a completely coupled condition.

Figure 12:
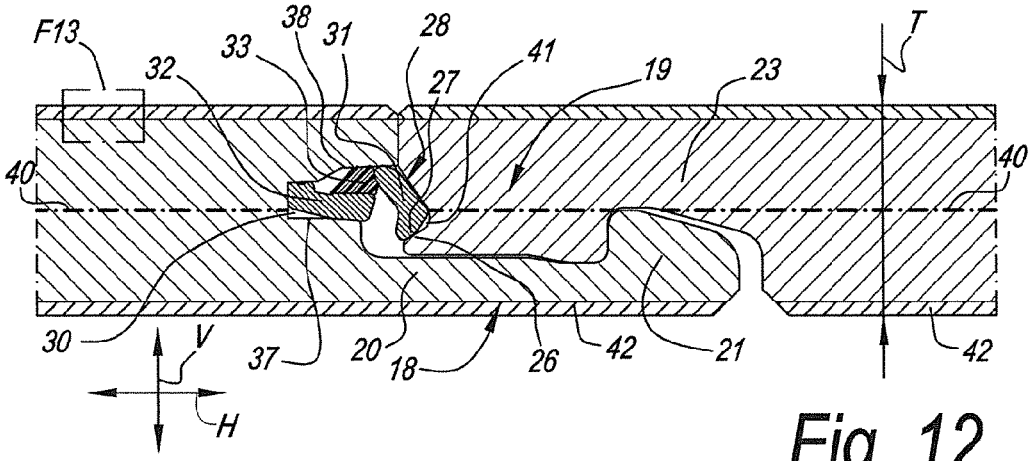
FIG. 12 represents a variant of the invention, for a view similar to that of FIG. 7.

In FIG. 12, a variant of the invention is represented, wherein a reinforcing layer 40 is incorporated into the panel 1.

This reinforcing layer 40 as such can be in any form or any material. Preferably, however, it is made on the basis of glass fiber, for example, in the form of a glass fiber net, a glass fiber mat, a layer of strewn-in glass fibers or the like.

According to a preferred aspect, the whole is configured such that the reinforcing layer 40 defines a plane, which, in the coupled condition of two of such panels, extends through the separate locking element 28 or at least through a portion thereof. Moreover, it is also preferred that this plane intersects at least the recess 30 in which the locking element 28 is provided, or intersects a recess 41 which is provided for forming the locking part 26, and still better intersects both of these recesses 30 and 41. Hereby, an even balance is obtained in respect to possible inner material forces, as a result of which the risk of possible undesired material deformations in the edge regions of the panels is minimized.

Further, it is also preferred that, at least when only one reinforcing layer is applied, this reinforcing layer 40, viewed in cross-section, is located in the middle of the substrate.

It is noted that also in embodiments in which a reinforcing layer 40 is applied, the substrate can be composed of one or more layers.

In order to obtain an even higher stability, also two or more of such reinforcing layers can be applied in the substrate, which layers then are located at a distance above each other. As a consequence of the higher stability thereby obtained, the positioning of the two or more layers in respect to the locking element 28 then is hardly critical.

It is noted that on such floor panels, as far as they comprise a top layer 35 provided on a substrate, a balancing backing layer 42 can be present on the underside, too. This backing layer is explicitly represented in FIG. 12 only, by way of example. It is also noted that the top layer 35 and the backing layer 42 in FIG. 12 are represented only schematically and that these layers in reality, in relation to the thickness of the substrate, mostly have a smaller thickness than is represented in the figure.

Figure 13:
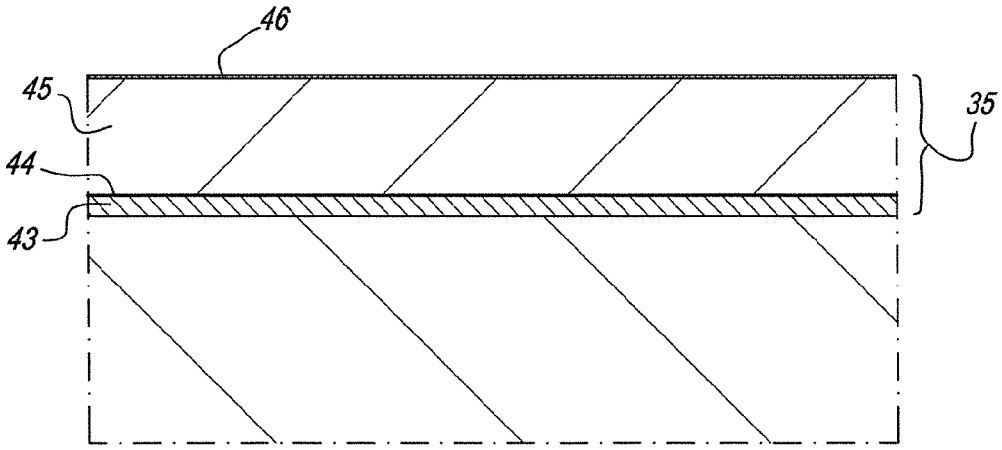
FIG. 13, at a larger scale, represents a view of the portion represented by F13 in FIG. 12.

FIG. 13 illustrates in greater detail how, for example, a top layer 35 of a panel according to the invention can be constructed. In this example, the top layer 35 consists of a film 43, for example, a PVC film, which is provided with a decorative print 44, and of a provided thereon transparent wear layer or film 45, as well as preferably also a transparent lacquer layer 46.

Figure 14:
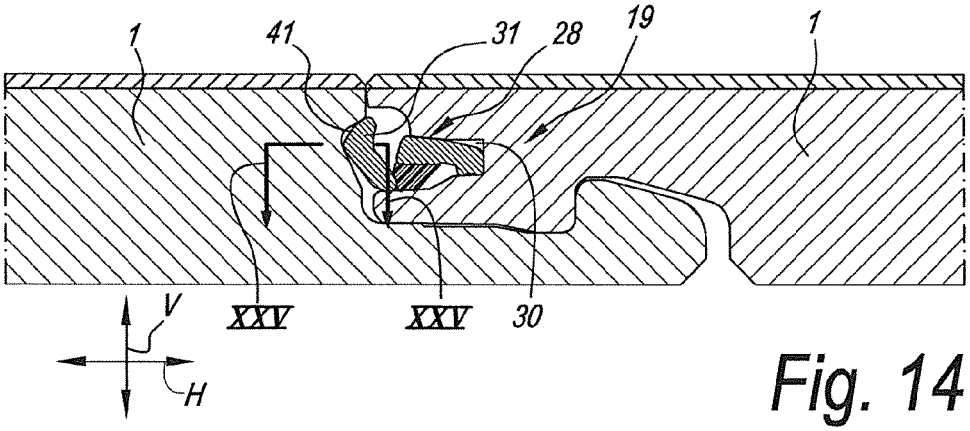
FIGS. 14, 15 and 16 represent three other variants of the invention.

In FIG. 14, a variant is represented, wherein the separate locking element 28 is mounted in the upper hook-shaped part 19. The turnable blocking body 31 then is directed upward with its free extremity. The recess 30 forms a seat for the locking element 28. The recess 41 is provided for forming a locking edge under which the blocking body 31 can engage.

Figure 15:
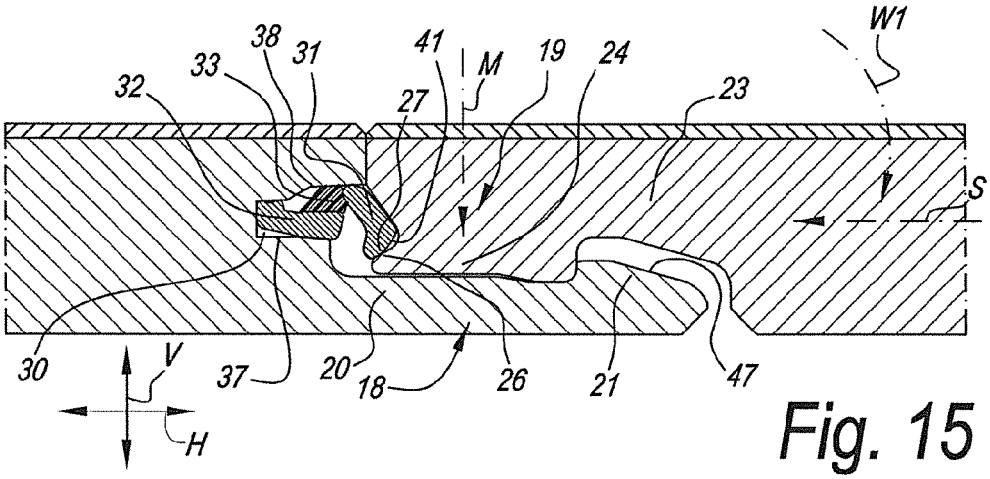

FIG. 15 represents another variant, wherein the locking elements 21 and 24 are configured such that two of such panels can be joined together at the respective edges by means of a downward movement M as well as a shifting and snap-on movement S. To this aim, the locking element 21 is realized relatively low and is also provided with a ramp surface 47. Possibly, also a joining by means of a turning movement W1 is possible.

Figure 16:
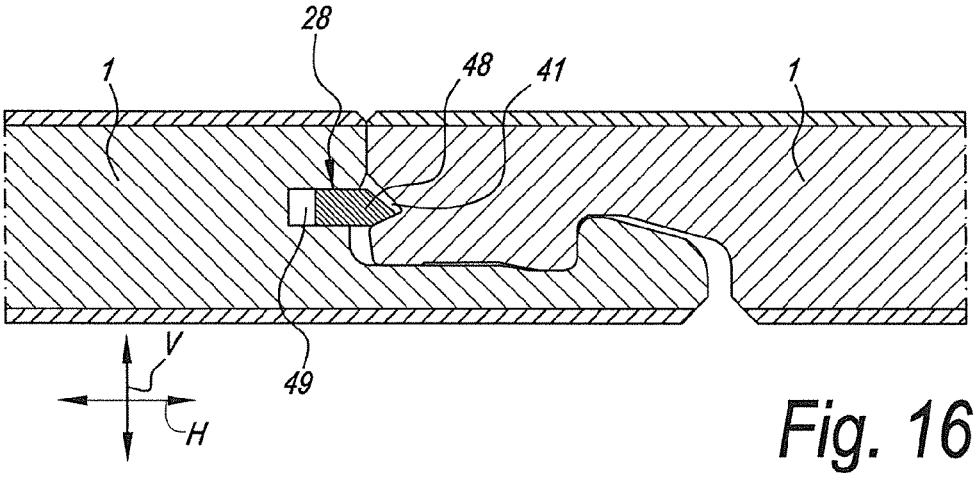

Although preferably use is made of separate locking elements of the type comprising a turnable blocking body 31, it is not excluded to apply other forms of separate locking elements. For example, as schematically illustrated in FIG. 16, use can be made of a locking element 28 in the form of a displaceable, more particularly slidable tongue 48.

In the example, this relates to a tongue in the form of a strip which is bent in a banana shape in the plane of the panel and thus protrudes in the middle from the recess 49 concerned. During the joining of the panels, the central portion of the tongue is bent elastically inward until the recess 41 arrives in front of the tongue and the tongue springs back outward, which results in the coupled condition.

It is clear that, when using a displaceable tongue, the invention is not restricted to such bent tongue. For example, use can also be made of a tongue behind which, whether or not attached thereto, a springy element is present which allows that the tongue, during coupling, can be displaced inward against an elastic force. According to another possibility, use shall be made of a tongue which is displaced outward as a result of the installation of a subsequent row of panels.

It is noted that, according to a not represented variant, such displaceable tongue can also be present on the locking part 19.

According to a particular embodiment of the invention, a separate locking element of metal is applied, preferably in the form of a metal strip and/or tongue. The advantage of using metal is that even with a very thin strip a sturdy connection can be realized as well as sufficient elastic force can be generated via the strip. The metal embodiment is particularly useful in combination with a tongue as illustrated in FIG. 16, as then, viewed in the height, a very thin and flat tongue which, for example, is bent in a banana shape, can be applied, for example, a tongue which in height extends over only 1 mm or less.

The coupling parts provided on the edges 4-5, including the locking portions, can also be made in one piece of the basic material of the actual floor panel, for example, as known, amongst others, from FIGS. 5-6 of EP 1.276.941B1.

Figure 17:
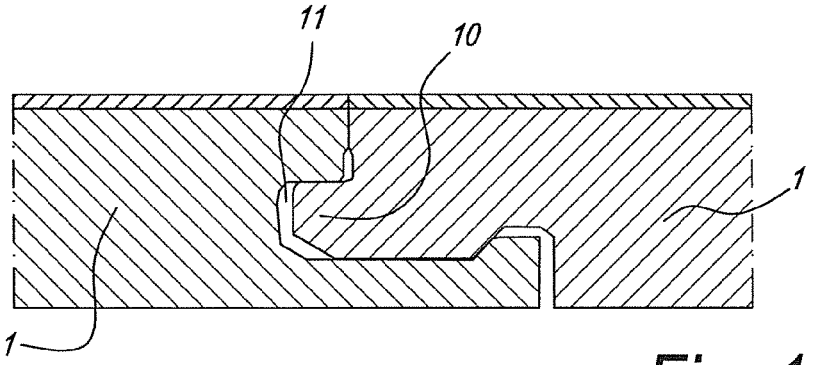
FIG. 17 represents a variant of the embodiment of FIG. 4.
Figure 18:
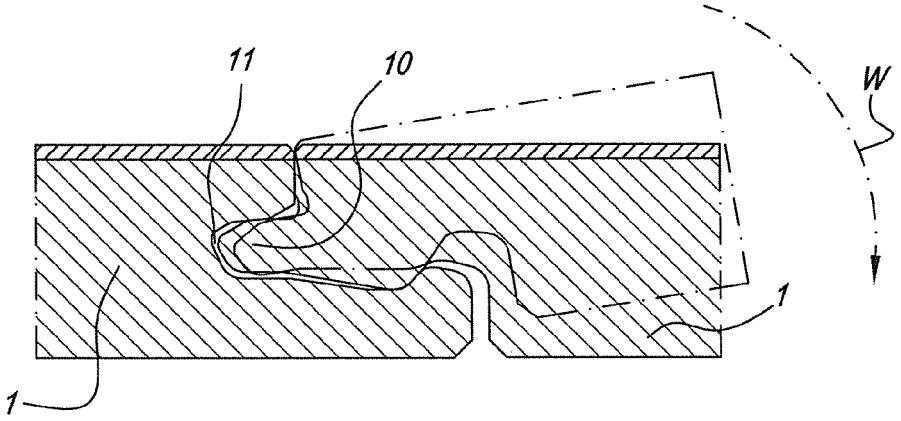
FIGS. 18 and 19 represent another variant of the embodiment of FIG. 4.
Figure 19:
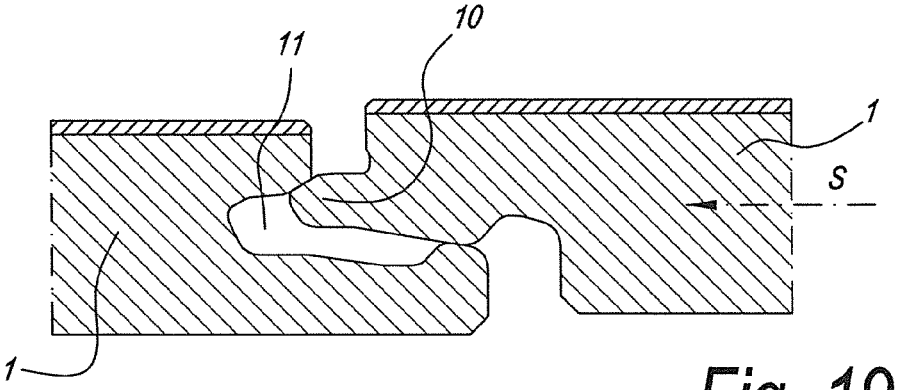

Further, it is also noted that coupling parts 6-7 of any shape can be applied on the first pair of edges 2-3 as well. As an example, FIG. 17 represents a variant with a more angled shape of the tongue and groove. FIGS. 18 and 19 represent still another variant, with a slimmer tongue, underneath which, in coupled condition, an interspace is extending.

All characteristics described herein above by means of FIGS. 1 to 19 have the purpose of describing the floor panels in which the invention shows its advantages particularly well. However, the essence of the present invention will be explained herein below with reference to FIGS. 20 to 29.

Figure 20:
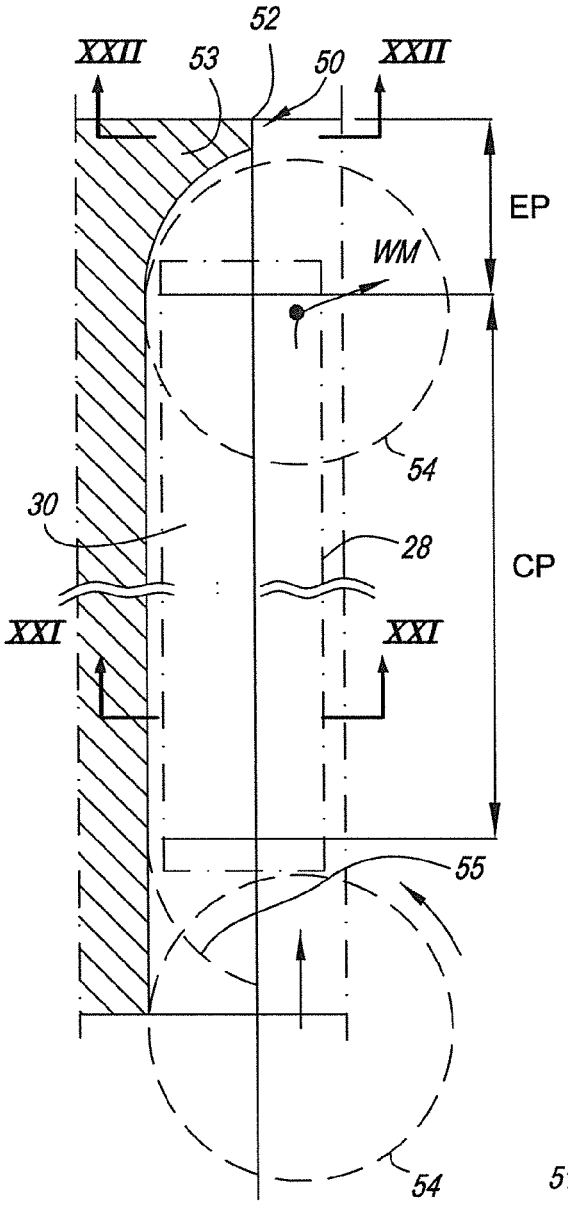
FIG. 20, at a larger scale and somewhat schematized, represents a cross-section according to line XX-XX in FIG. 5.
Figure 21:
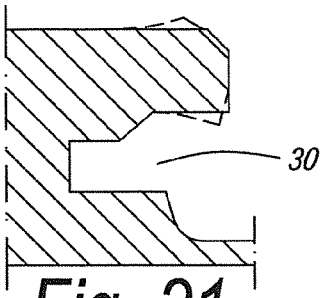
FIGS. 21 and 22 represent cross-sections according to lines XXI-XXI and XXII-XXII, respectively, in FIG. 20.
Figure 22:
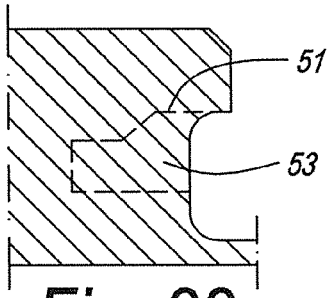

FIGS. 20 to 22 show that the recess 30 alters its shape towards the end 50 of the respective edge in respect to a portion situated more proximally according to the longitudinal direction of the edge, and that it more particularly even disappears completely or almost. FIG. 21 represents the normal shape of the recess 30. FIG. 22 relates to the shape in the proximity of the end 50, where the recess 30 substantially is non-existent. For comparison, the normal open shape is represented in dashed line 51.

If the recess 30 simply should continue up to the end 50, on top of the relatively weak corner point 52, as explained in the introduction, deformation might easily occur, for example, as illustrated in dashed line in FIG. 21, such, for example, during the installation of the floor panels. As now, according to the invention, a material portion 53 is provided, this corner point is reinforced and the risk of deformations, defects and/or faulty interconnecting the joints of the floor panels is minimized.

Figure 23:
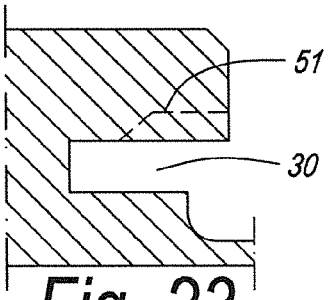
FIGS. 23 and 24, in a cross-section similar to that of FIG. 22, represent another two variants.

In the variant of FIG. 23, the additional material portion 53 is exclusively present against the upper side of the recess 30, which already offers a reinforcement, too.

Figure 24:
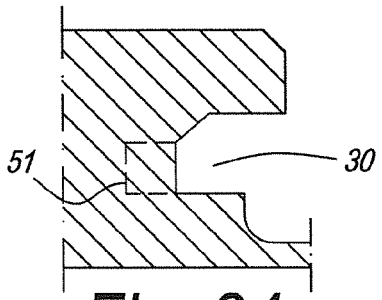
Figure 25:
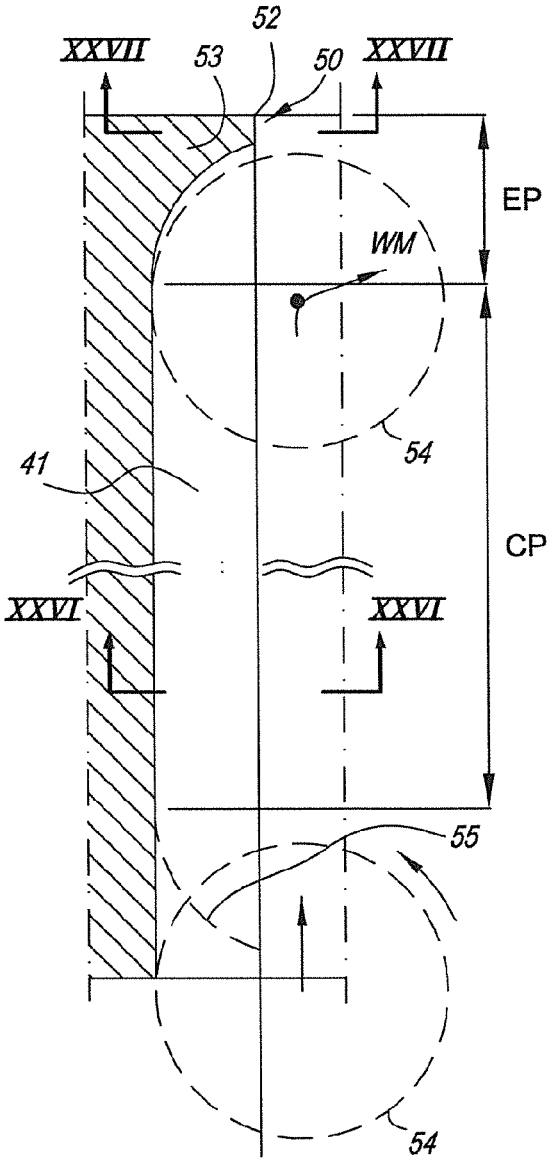
FIG. 25, at a larger scale and somewhat schematized, represents a cross-section according to line XXV-XXV in FIG. 14.
Figure 26:
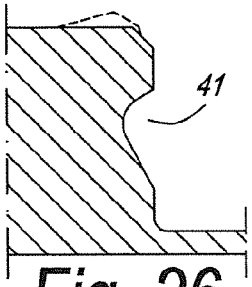
FIGS. 26 and 27 represent cross-sections according to lines XXVI-XXVI and XXVII-XXVII, respectively, in FIG. 25.
Figure 27:
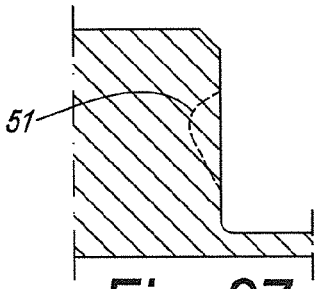
Figure 28:
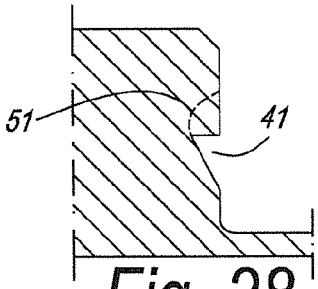
FIGS. 28 and 29, in a cross-section similar to that of FIG. 27, represent another two variants.
Figure 29:
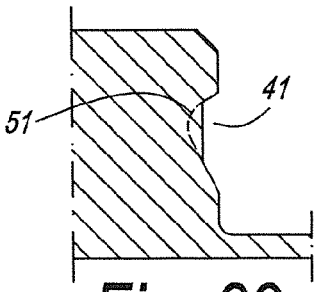

In FIG. 24, the additional material portion 53 is present in the interior of the recess 30, in other words, seen in cross-section there is more material present in the proximal part of the recess.

It is clear that the material portion 53 can also function as a stop for the strip-shaped locking element 28 in order to prevent that the latter is mounted too close to a long side, as can be seen in the schematic illustration of FIG. 20.

In the example, the final recess 30, and maintaining the material portion 53, is formed exclusively by removing material from the floor panel. Schematically, it is represented that this can be realized by means of moving at least one rotating machining tool along the edge and placing it in the proximity of the end 50, relative in respect to the floor panel, in drawn-away position, for example, moving it away as indicated by the draw-away movement WM. One may also work in reverse order, wherein the tool 54 first is displaced along the end with little or no engagement, such that the material portion 53 is maintained, and only then letting said tool engage deeper in order to form the recess 30.

Depending on the application and the desired effect, such material portion 53 can be formed on only one or on both ends of the edge. The possible forming of a material portion on the other end is represented schematically by dashed line 55.

In FIG. 20, for clarity's sake also the central portion and end portion, mentioned in the introduction, are represented, by CP and EP, respectively.

FIGS. 25 to 29 represent views which relate to the recess 41 in FIG. 14 and are analogous to FIGS. 20 to 24.

According to a not represented embodiment, the recess, for example, 30 or 41, in fact can have a uniform cross-section towards the respective end of the edge; however, for example, the recess can somewhat peter out downward towards the end, for example, end 50; in other words, it can be situated lower in the edge. To this end, above the recess at the end 50 more material remains present and the corner zone is less weakened at the top.

The independent second aspect of the invention mentioned in the introduction comprises four independent possibilities, which will be explained in more detail herein after with reference to FIGS. 30 to 33 as well as with reference to the respective attached claims. As aforementioned, this second aspect specifically aims at floor panels of synthetic material, which are supple. What has to be understood by the term "supple" has already been explained herein above, amongst others, within the scope of the description of the first aspect.

Further, the second aspect aims at solutions for counteracting edge deformations by reducing the risk of the occurrence thereof.

Figure 30:
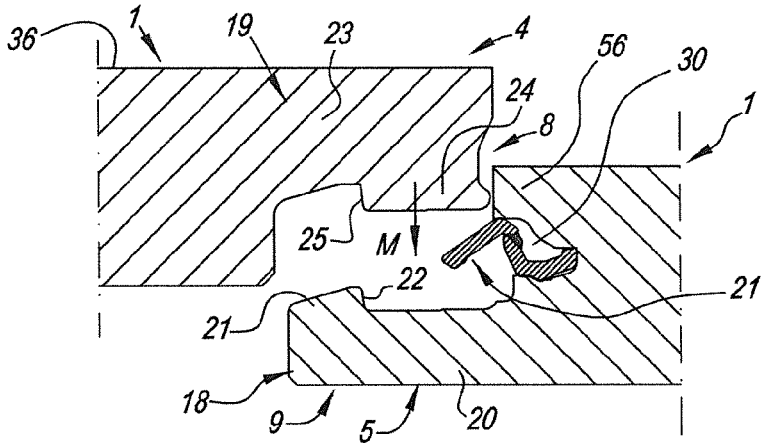
FIGS. 30 to 32 represent two floor panels during the coupling thereof, wherein these are realized in accordance with the second aspect of the invention.
Figure 31:
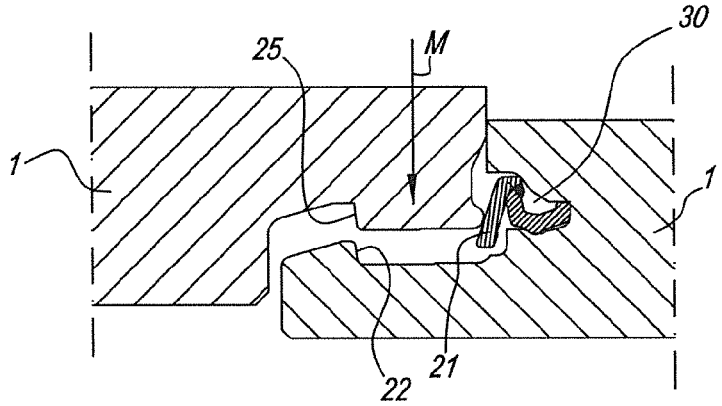
Figure 32:
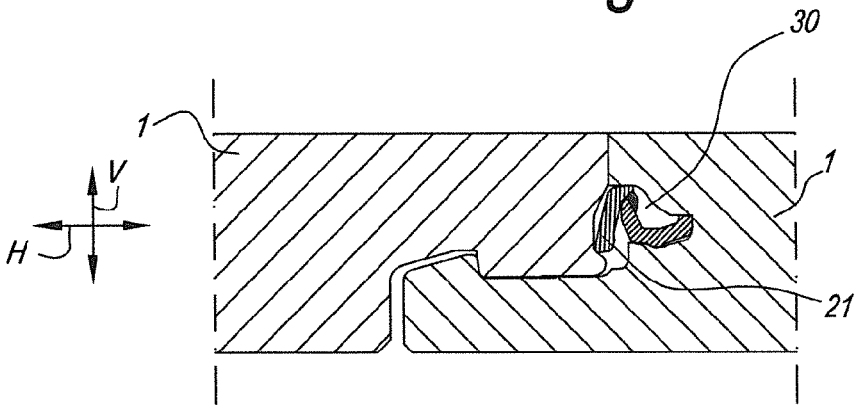
Figure 33:
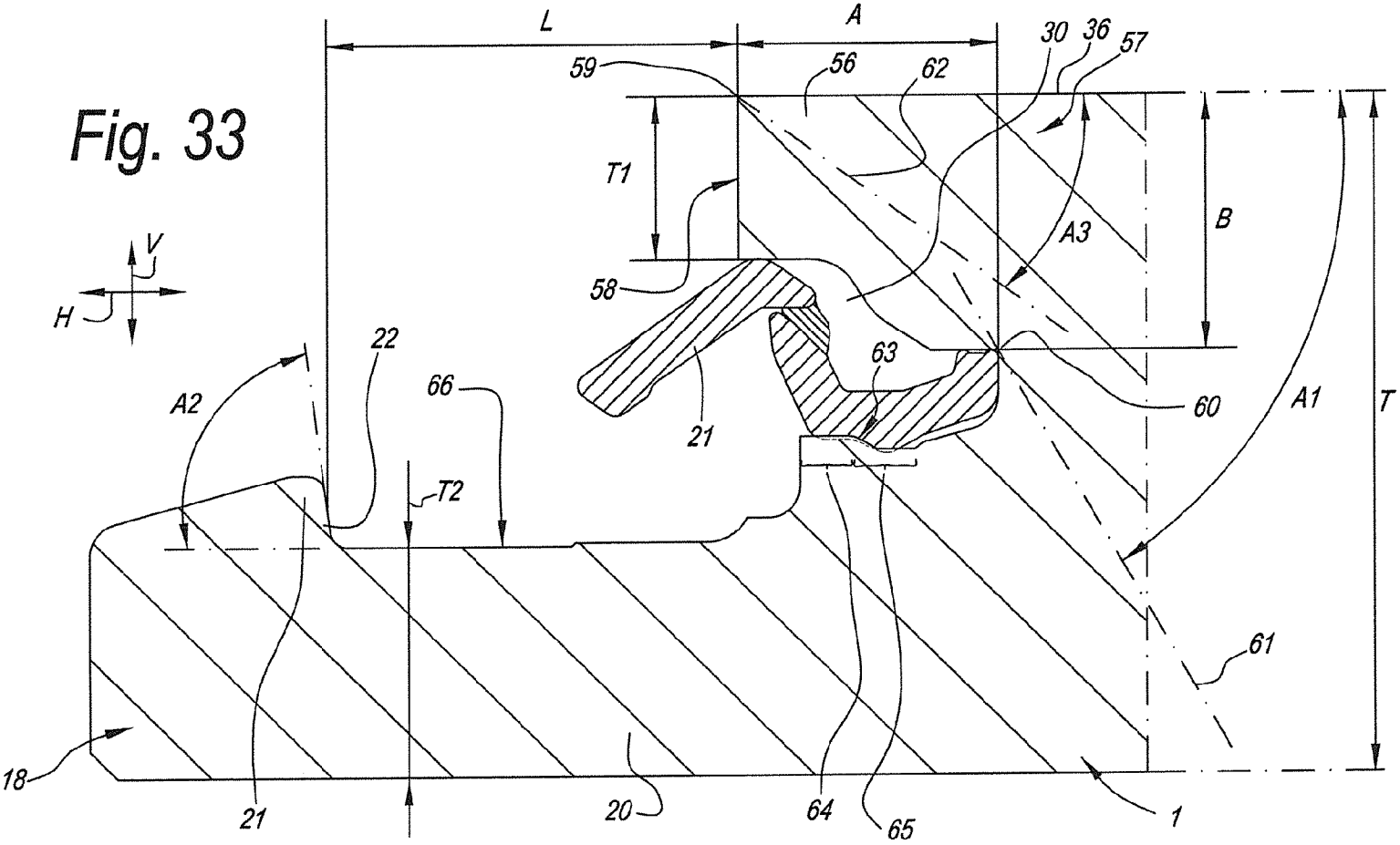
FIG. 33, at a larger scale, represents the right-hand edge portion from FIG. 30.

According to the second aspect, this is realized by applying well-defined configurations, wherein according to the invention four possibilities can be applied. The example of FIGS. 30 to 33 applies all four possibilities. FIGS. 30 to 32 represent how the respective edges can be coupled to each other, whereas FIG. 33, at a larger scale, shows the right-hand edge portion in order to illustrate the configuration thereof more clearly.

According to the first possibility, the second aspect provides for a floor panel for forming a floor covering, wherein this floor panel substantially consists of synthetic material and is of the supple type;

wherein this floor panel 1, as represented, on at least one pair of opposite edges 4-5, comprises coupling parts 8-9, which allow joining two of such floor panels by means of a downward movement M of one floor panel 1 in respect to the other floor panel, wherein these coupling parts 4-5 allow a locking in a first direction V perpendicular to the plane of the floor panels 1 as well as in a second direction H perpendicular to the respective edge 4-5 and in the plane of the floor panels 1;

wherein the coupling parts 8-9 comprise a first locking system for the locking in said first direction and a second locking system for the locking in said second direction;

wherein the second locking system substantially is formed of an upwardly directed lower hook-shaped part 18 situated on an edge 5, as well as of a downwardly directed upper hook-shaped part 19 situated on the opposite edge 4, which hook-shaped parts can be engaged behind each other by said downward movement M;

wherein the lower hook-shaped part 18 consists of a lip 20 which extends laterally from the lower edge of the panel 1 and which is provided with an upwardly directed locking element 21 with a locking surface 22, whereas the upper hook-shaped part 19 consists of a lip 23 which extends laterally from the upper edge of the panel 1 and which is provided with a downwardly directed locking element 24 with a locking surface 25;

wherein said first locking system comprises a separate locking element 21;

wherein this locking element 21 is provided in a longitudinal recess 30 which is present on the respective edge at a distance underneath the upper surface, more particularly the upper side 36, and is separated from the upper surface by a lip-shaped part 56;

wherein this lip-shaped part 56, seen in cross-section, comprises a proximal end 57 and a distal end 58 and wherein the distal end defines an upper edge;

wherein the lip-shaped part 56, near the proximal end, has a thickness, herein below denominated proximal thickness B, wherein this proximal thickness B is formed by a distance perpendicular to the upper surface, measured from the upper surface to a tangent point 60 determined by a line 61 at an angle of 60° with said upper surface, which is directed downward in proximal direction and which is tangential to said recess 30; and wherein the lip-shaped part 56, seen in cross-section, has a horizontal length A which is formed by the horizontal distance between the most distal end of the lip-shaped part 56 and the most proximal point of said recess 30;

characterized in that the floor panel combines the following two features:

- on the one hand, that said locking surfaces 22-25 are configured such that in the coupled condition, on a location where they contact each other, they form an angle A2 with the plane of the floor panel which is different from 90 degrees;
- and, on the other hand, that said lip-shaped part 56 shows at least one of the following features or a combination of any two or three of the following features, or all four of the following features:
  - the ratio B/A of said proximal thickness B to said horizontal length A is larger than 0.75;
  - said recess is situated over its entire depth, possibly with the exception of the first 10% of its depth, below an imaginary line 62 which extends through said upper edge and is inwardly sloping downward over an angle A3 of 36 degrees;
  - said horizontal length A, or thus the depth of the recess, is less than 2.4 mm and still better less than 2.2 mm;
  - said horizontal length A is smaller than 0.4 times the overall thickness T of the floor panel.

By applying this first possibility, a relatively large quantity of material is kept in the lip-shaped part 56, towards the proximal end 57 thereof, or at least a solid basis for the portion 56 is provided, which counteracts the occurrence of a possible deformation. By the locking surfaces 22-25, which are standing at an angle, the effect is obtained that the locking part 24 can settle better elastically than in the case of vertical locking surfaces, by which possible deformations in the proximity of the upper edge can disappear easier on their own. By the combination of these two characteristics, a synergetic effect is created which provides for a high dimensional stability.

According to the second possibility, the second aspect provides for a floor panel for forming a floor covering, wherein this floor panel substantially consists of synthetic material and is of the supple type;

wherein the floor panel 1, on at least one pair of opposite edges 4-5, comprises coupling parts 8-9 which allow joining two of such floor panels by means of a downward movement M of one floor panel 1 in respect to the other floor panel, wherein these coupling parts 4-5 allow a locking in a first direction V perpendicular to the plane of the floor panels 1 as well as in a second direction H perpendicular to the respective edge 4-5 and in the plane of the floor panels 1;

wherein the coupling parts 8-9 comprise a first locking system for the locking in said first direction and a second locking system for the locking in said second direction;

wherein the second locking system substantially is formed of an upwardly directed lower hook-shaped part 18 situated on an edge 5, as well as of a downwardly directed upper hook-shaped part 19 situated on the opposite edge 4, which hook-shaped parts, when interconnecting two such floor panels, can be engaged behind each other by said downward movement M;

wherein the lower hook-shaped part 18 consists of a lip 20 which extends laterally from the lower edge of the panel 1 and which is provided with an upwardly directed locking element 21 with a locking surface 22, whereas the upper hook-shaped part 19 consists of a lip 23 which extends laterally from the upper edge of the panel 1 and which is provided with a downwardly directed locking element 24 with a locking surface 25;

wherein said first locking system comprises a separate locking element 21;

wherein this locking element 21 is provided in a longitudinal recess 30 which is present on the respective edge at a distance underneath the upper surface, more particularly the upper side 36, and is separated from the upper surface 36 by a lip-shaped part 56;

wherein this lip-shaped part 56, seen in cross-section, comprises a proximal end 57 and a distal end 58 and wherein the distal end defines an upper edge 59;

wherein the lip-shaped part 56, near the proximal end, has a thickness B, herein below denominated proximal thickness B, wherein this proximal thickness B is formed by a distance perpendicular to the upper surface, measured from the upper surface to a tangent point 60 determined by a line 61 at an angle A1 of 60° with said upper surface, which is directed downward in proximal direction and which is tangential to said recess; and wherein the lip-shaped part 56, seen in cross-section, has a horizontal length A which is formed by the horizontal distance between the most distal end of the lip-shaped part 56 and the most proximal point of said recess 30;

characterized in that the floor panel combines the following two features:

on the one hand, that the recess is bordered by a bottom wall 63 consisting at least of a first portion 64 and a second portion 65, of which the second portion 65 is situated more inwardly than the first portion and also is situated lower than the first portion;

and, on the other hand, that said lip-shaped part 56 shows at least one of the following features or a combination of any two or three of the following features, or all four of the following features:

the ratio B/A of said proximal thickness B to said horizontal length A is larger than 0.75;

said recess 30 is situated over its entire depth, possibly with the exception of the first 10% of its depth, below an imaginary line 62 which extends through said upper edge 59 and is inwardly sloping downward over an angle A3 of 36 degrees;

said horizontal length A, or thus the depth of the recess, is less than 2.4 mm and still better less than 2.2 mm;

said horizontal length is smaller than 0.4 times the overall thickness T of the floor panel.

By applying this second possibility, a relatively large quantity of material is kept in the lip-shaped part 56, towards the proximal end 57 thereof, or at least a solid basis for the portion 56 is provided, which counteracts the occurrence of a possible deformation, whereas by the deeper-situated second portion more room is offered for providing a locking element, without the necessity of thinning and weakening the lip-shaped part 56. Thus, the risk of deformations in the lip-shaped part is reduced.

It is clear that a combination of the first possibility and second possibility can be made.

According to the third possibility, the second aspect provides for a floor panel for forming a floor covering, wherein this floor panel substantially consists of synthetic material and is of the supple type;

wherein the floor panel 1, on at least one pair of opposite edges 4-5, comprises coupling parts 8-9 which allow joining two of such floor panels by means of a downward movement M of one floor panel 1 in respect to the other floor panel, wherein these coupling parts 4-5 allow a locking in a first direction V perpendicular to the plane of the floor panels 1 as well as in a second direction H perpendicular to the respective edge 4-5 and in the plane of the floor panels 1;

wherein the coupling parts 8-9 comprise a first locking system for the locking in said first direction V and a second locking system for the locking in said second direction H;

wherein the second locking system substantially is formed of an upwardly directed lower hook-shaped part 18 situated on an edge 5, as well as of a downwardly directed upper hook-shaped part 19 situated on the opposite edge 4, which hook-shaped parts, when interconnecting two such floor panels, can be engaged behind each other by said downward movement M;

wherein the lower hook-shaped part 18 consists of a lip 20 which extends laterally from the lower edge of the panel 1 and which is provided with an upwardly directed locking element 21 with a locking surface 22, whereas the upper hook-shaped part 19 consists of a lip 23 which extends laterally from the upper edge of the panel 1 and which is provided with a downwardly directed locking element 24 with a locking surface 25;

wherein the lower hook-shaped part comprises an engagement portion 66 for the upper hook-shaped part 19;

wherein said first locking system comprises a separate locking element 21;

wherein this locking element 21 is provided in a longitudinal recess 30 which is present on the respective edge at a distance underneath the upper surface, more particularly the upper side 36, and is separated from the upper surface by a lip-shaped part 56;

wherein this lip-shaped part 56, seen in cross-section, comprises a proximal end and a distal end and wherein the distal end defines an upper edge 59;

wherein the lip-shaped part 56, near the proximal end, has a thickness B, herein below denominated proximal thickness B, wherein this proximal thickness B is formed by a distance perpendicular to the upper surface, measured from the upper surface to a tangent point 60 determined by a line 61 at an angle A1 of 60° with said upper surface, which is directed downward in proximal direction and which is tangential to said recess; and wherein the lip-shaped part 5, seen in cross-section, has a horizontal length A which is formed by the horizontal distance between the most distal end of the lip-shaped part and the most proximal point of said recess 30;

characterized in that said engagement portion 66 has a length L which is greater than or equal to 1.2 times the aforementioned horizontal length A, however, is smaller than or equal to 1.8 times this horizontal length A.

By applying this third possibility, a compromise is obtained between the deformability of the lip-shaped part 56, which depends on the length thereof, the stability of the coupling, by keeping the length L limited and thus keeping a certain rigidity, and a smooth joinability by not overly restricting the distance L and thus still maintaining a certain movability in the lower lip.

In a preferred embodiment of the third possibility, the floor panel also shows one or more of the following features:

- the ratio B/A of said proximal thickness B to said horizontal length A is larger than 0.75;
- said recess 30 is situated over its entire depth, possibly with the exception of the first 10% of its depth, below an imaginary line 62 which extends through said upper edge 59 and is inwardly sloping downward over an angle A3 of 36 degrees;
- said horizontal length A, or thus the depth of the recess, is less than 2.4 mm and still better less than 2.2 mm;
- said horizontal length is smaller than 0.4 times the overall thickness T of the floor panel;
- said locking surfaces 22-25 are configured such that they, in coupled condition, at a location where they contact each other, form an angle with the plane of the floor panel which is different from 90 degrees;
- the recess is bordered by a bottom wall 63 which consists at least of a first portion 64 and a second portion 65, of which the second portion 65 is situated more inwardly than the first portion 64 and is also situated lower than the first portion.

According to the fourth possibility, the second aspect provides for a floor panel for forming a floor covering, wherein this floor panel substantially consists of synthetic material and is of the supple type;

wherein the floor panel 1, on at least one pair of opposite edges 4-5, comprises coupling parts 8-9 which allow joining two of such floor panels by means of a downward movement M of one floor panel 1 in respect to the other floor panel, wherein these coupling parts 4-5 allow a locking in a first direction V perpendicular to the plane of the floor panels 1 as well as in a second direction H perpendicular to the respective edge 4-5 and in the plane of the floor panels 1;

wherein the coupling parts 8-9 comprise a first locking system for the locking in said first direction and a second locking system for the locking in said second direction;

wherein the second locking system substantially is formed of an upwardly directed lower hook-shaped part 18 situated on an edge 5, as well as of a downwardly directed upper hook-shaped part 19 situated on the opposite edge 4, which hook-shaped parts, when interconnecting two such floor panels, can be engaged behind each other by said downward movement M;

wherein the lower hook-shaped part 18 consists of a lip 20 which extends laterally from the lower edge of the panel 1 and which is provided with an upwardly directed locking element 21 with a locking surface 22, whereas the upper hook-shaped part 19 consists of a lip 23 which extends laterally from the upper edge of the panel 1 and which is provided with a downwardly directed locking element 24 with a locking surface 25;

wherein the lower hook-shaped part comprises an engagement portion 66 for the upper hook-shaped part 19;

wherein said first locking system comprises a separate locking element 21;

wherein this locking element 21 is provided in a longitudinal recess 30 which is present on the respective edge at a distance underneath the upper surface and is separated from the upper surface by a lip-shaped part 56; and wherein this lip-shaped part 56, seen in cross-section, comprises a proximal end and a distal end;

characterized in that said lip-shaped part 56, at the distal end thereof, has a global thickness T1 which is larger than 15% of the overall thickness T of the floor panel, whereas the smallest thickness T2 of said lower lip 14, at the location of the engagement portion 66 thereof, is larger than 30% of the overall thickness T of the floor panel.

According to this fourth possibility, a compromise is offered between the values T1 and T2 and the overall thickness T, such that the negative influence resulting from the weakening which is created by the presence of the recess 30 will be distributed over the lip-shaped portion 56 and the lower lip 20 in a balanced manner.

In the case of the fourth possibility, in a preferred embodiment this relates to a floor panel wherein the lip-shaped part 56, next to the proximal end, has a thickness B, herein below denominated proximal thickness B, wherein this proximal thickness B is formed by a distance perpendicular to the upper surface, measured from the upper surface to a tangent point 60 determined by a line 61 at an angle A1 of 60° with said upper surface, which is directed downward in proximal direction and which is tangential to said recess; and wherein the lip-shaped part 56, seen in cross-section, has a horizontal length A which is formed by the horizontal distance between the most distal end of the lip-shaped part and the most proximal point of said recess 30;

and having the characteristic that the floor panel also shows one or more of the following features:

- the ratio B/A of said proximal thickness B to said horizontal length A is larger than 0.75;
- said recess 30 is situated over its entire depth, possibly with the exception of the first 10% of its depth, below an imaginary line 62 which extends through said upper edge 59 and is inwardly sloping downward over an angle A3 of 36 degrees;
- said horizontal length A, or thus the depth of the recess, is less than 2.4 mm and still better less than 2.2 mm;
- said horizontal length is smaller than 0.4 times the overall thickness T of the floor panel;
- said locking surfaces 22-25 are configured such that they, in coupled condition, at a location where they contact each other, form an angle with the plane of the floor panel which is different from 90 degrees;
- the recess is bordered by a bottom wall 63 which consists at least of a first portion 64 and a second portion 65, of which the second portion 65 is situated more inwardly than the first portion 64 and is also situated lower than the first portion;
- the lower hook-shaped part comprises an engagement portion for the upper hook-shaped part, wherein said engagement portion has a length L which is greater than or equal to 1.2 times the aforementioned horizontal length A, however, is smaller than or equal to 1.8 times this horizontal length A.

It is noted that all four possibilities can be combined at choice, as well as each possibility can be combined further with any partial characteristic of another possibility. Various combinations are represented in the dependent claims.

Preferably, according to the second aspect of the invention use is made of a recess 30 having a cross-section which is uniform along the entire edge, which is considerably easier to produce than a recess which varies in shape.

The second aspect substantially aims at embodiments wherein, as represented in FIGS. 30-33, the locking element and the recess formed for this purpose are located in the female part, in other words, on the edge which is provided with the lower hook-shaped part 18.

It is clear that the invention shows its advantages best in floor panels which further also show characteristics as described in the introduction in respect to the second aspect, as in particular in such floor panels, as a result of their composition and their material, deformations can occur when joining them, which then, according to the invention, is counteracted.

In preferred embodiments, the floor panel is also characterized by one or more of the following groups of features:

- that the floor panel is rectangular, either oblong rectangular or square; wherein said pair of opposite edges 4-5 forms a first pair of edges, whereas the remaining two opposite edges 2-3 form a second pair of edges; wherein on the second pair of edges of the floor panel 1, coupling parts 6-7 are provided, of the type which allows coupling two of such floor panels 1 to each other along the respective edges by means of a turning movement W, wherein these coupling parts provide for a vertical and a horizontal locking and preferably are made in one piece with the floor panel 1;
- that the coupling means on the first pair of edges and the second pair of edges are formed such that such panels can be installed via the so-called "fold-down" principle, in other words, that the coupling parts on the second pair of edges allow coupling the panels, via a downward turning movement, to panels of a preceding row, whereas as a result of such turning movements a locking on the first edges with an adjacent panel is effected as well;
- that the separate locking element 28 is made as an insert in the form of a strip, wherein this separate locking element comprises at least a portion 31 which is laterally movable and in this manner can cooperate with a locking portion 32 on an adjacent similar floor panel;
- that said laterally movable portion 31 is elastically movable, such that this portion, during coupling of two such floor panels 1, is moved sideways, against an elastic force, in order to then come back into a locking position;
- that the locking element is at least composed of an attachment portion and a pivotable blocking body;
- that the locking element is made in the form of a displaceable, more particularly slidable, tongue 48;
- that the floor panel has a thickness T of less than 6 mm, and more specifically in the order of magnitude of 5 mm or even less than 5 mm;
- that the floor panel 1, or at least the substrate 34 of the floor panel, substantially is composed of a thermoplastic material, preferably of a soft thermoplastic material;
- that the floor panel 1 substantially is composed of a substrate 3 and a top layer 35;
- that the floor panel 1, or at least the substrate 34 of the floor panel 1, substantially is composed of polyvinyl chloride, more particularly of soft polyvinyl chloride, and still more particularly has a substrate 34 which comprises plasticizers;
- that the floor panel 1 is a vinyl panel, more particularly a so-called vinyl tile, and in particular a panel of the so-called LVT type ("Luxury Vinyl Tile") or VCT type ("Vinyl Composite Tile", also called "Vinyl Composition Tile");
- that the floor panel 1, or at least the substrate 34 of the floor panel 1, substantially is formed on the basis of polyurethane or polypropylene;
- that it comprises a substrate which is provided with fillers, such as chalk;
- that it is provided with a reinforcement layer 40.

It is noted that in embodiments in which the ratio B/A is larger than 0.75, the recess 30 preferably is situated entirely on the bottom side of a straight connection line which connects the upper edge 59 with the tangent point 60, by which a high stability is offered not only on the basis of the lip-shaped part 56, but also over the entire length of the lip-shaped part 56.

For clarity's sake, it is emphasized that also in embodiments of the second aspect the locking element 21 does not necessarily have to be of the type as that depicted in FIGS. 30 to 33, thus, with a pivotable locking body. Other types of locking elements are applicable, for example, of the type as described herein above with reference to FIG. 16.

Said first portion 64 and lower-situated second portion 65 do not necessarily have to show the represented shape and do not have to merge into each other in a stepped way. According to a not-represented embodiment, the lower wall 63 can be continuously sloping, wherein a highest portion can be considered the first portion and a lower successive portion can be considered the second portion.

The upper wall of the recess 30 preferably is shaped such that, globally seen, the lip-shaped part increases in thickness from the distal end 58 towards the proximal end 57, either stepped or gradually.

The represented angle A2 under which the locking surfaces cooperate, which normally coincides with an angle or mean angle of the locking surface 22, is smaller than 90 degrees when applying the first possibility, however, preferably is rather steep. More particularly, it is preferred that this angle is located between 70 and 88 degrees and still better between 80 and 88 degrees and still better is approximately 85 degrees. In embodiments in which said first possibility is not applied, the angle A2 may even be 90 degrees or even be somewhat larger.

It is clear that the structural characteristics described by means of FIGS. 1 to 32 can also be applied at choice in embodiments according to the second aspect, in as far as they are not contradictory to the intended first, second, third or fourth possibility of the second aspect.

It is noted that, by definition, by the upper edge 59 the point of intersection must be understood between the prolongation of the upper surface 36 and the vertical theoretical closure surface between two coupled floor panels. This then also means that in the case that a chamfer or rounding is applied on the edge of the floor panel, an imaginary edge, which is determined by said point of intersection, is intended as the upper edge.

It is also noted that the tangent point 60, which determines the lowermost point of distance B, does not necessarily coincide with the end of distance A. In fact, the tangent point 60, per definition, is determined by the line 61 which is presented to the recess tangentially at 60 degrees. In the case that the most proximal end of the recess 30, for example, is rounded, the tangent point can be situated on another location.

Further, it is noted that for the length L of the engagement portion, by definition the horizontal length must be taken into account between the vertical closing surface of the floor panels, on the one hand, and the center of the locking surface 22, irrespective whether the actual engagement takes place over the complete length L or not.

By the locking surfaces 22 and 25 substantially the zones thereof are meant where the floor panels in coupled condition are in contact with each other.

Herein above, said thickness T1 is paraphrased as "global thickness", as hereby the substantial thickness at the height of the distal end is meant, wherein the possible presence of a chamfer or an undercut, for achieving a better adjoining among the panels, are not to be taken into account when determining the thickness.

Although the invention is primarily intended for being employed in floor panels, according to the invention the application in other panels is not excluded, wherein then the herein above-described directions "vertical" and "horizontal" then must be applied to such panel when the panel is put down on the ground with its decor side directed upward.

The present invention is in no way restricted to the herein above-described embodiments; on the contrary, such floor panels, floor coverings and methods for manufacturing them can be realized according to various variants, without leaving the scope of the present invention.

The invention claimed is:

1. A floor panel for forming a floor covering, wherein the floor panel substantially consists of synthetic material and is of the supple type;

wherein the floor panel, on at least one pair of opposite edges, comprises coupling parts which allow joining two of such floor panels by means of a downward movement (M) of one floor panel in respect to the other floor panel, wherein these coupling parts allow a locking in a first direction (V) perpendicular to the plane of the floor panels as well as in a second direction (H) perpendicular to the respective edge and in the plane of the floor panels;

wherein the coupling parts comprise a first locking system for the locking in said first direction and a second locking system for the locking in said second direction;

wherein the second locking system substantially is formed of an upwardly directed lower hook-shaped part situated on an edge, as well as of a downwardly directed upper hook-shaped part situated on the opposite edge, which hook-shaped parts can be engaged behind each other by said downward movement M;

wherein the lower hook-shaped part consists of a lip which extends laterally from the lower edge of the panel and which is provided with an upwardly directed locking element with a locking surface, whereas the upper hook-shaped part consists of a lip which extends laterally from the upper edge of the panel and which is provided with a downwardly directed locking element with a locking surface;

wherein said first locking system comprises a separate locking element;

wherein the locking element is provided in a longitudinal recess which is present on the respective edge at a distance underneath the upper surface, and is separated from the upper surface by a lip-shaped part;

wherein the lip-shaped part, in a cross-section, comprises a proximal end and a distal end and wherein the distal end defines an upper edge;

wherein the lip-shaped part, near the proximal end, has a thickness, herein below denominated proximal thickness (B), wherein the proximal thickness (B) is formed by a distance perpendicular to the upper surface, measured from the upper surface to a tangent point determined by a line at an angle (A1) of 60° with said upper surface, which is directed downward in proximal direction and which is tangential to said recess;

wherein the lip-shaped part, in a cross-section, has a horizontal length (A) which is formed by the horizontal distance between the most distal end of the lip-shaped part and the most proximal point of said recess; and wherein the floor panel combines the following two features:

said locking surfaces are configured such that in the coupled condition, on a location where they contact each other, they form an angle (A2) different from 90 degrees with the plane of the floor panel; and said lip-shaped part shows at least one of the following features or a combination of any two or three of the following features, or all four of the following features:

the ratio (B/A) of said proximal thickness (B) to said horizontal distance (A) is larger than 0.75;

said recess is situated over its entire depth, possibly with the exception of the first 10% of its depth, below an imaginary line which extends through said upper edge and is inwardly sloping downward over an angle (A3) of 36 degrees;

said horizontal length (A), or thus the depth of the recess, is less than 2.4 mm;

said horizontal length (A) is smaller than 0.4 times the overall thickness (T) of the floor panel;

wherein said floor panel has a suppleness defined such that when the floor panel has a rectangular shape with a pair of short sides and a pair of long sides, with a width of less than 50 centimeters measured along one side of the short sides, and when the floor panel is fixedly clamped on one side of the pair of short sides of the floor panel to project over a length of 100 centimeters, the floor panel, starting from a flat horizontal position, will bend under the influence of its own weight, such that at a height of a free extremity portion of the floor panel, the bending is at least 10 centimeters in respect to a clamped portion of the floor panel, when a bending time of at least 10 seconds is considered.

2. The floor panel of claim 1, wherein the locking element is at least composed of an attachment portion and a pivotable blocking body.

3. The floor panel of claim 1, wherein the locking element is made in the form of a displaceable tongue.

4. The floor panel of claim 1, wherein the floor panel has a thickness (T) of less than 6 mm.

5. A floor panel for forming a floor covering, wherein the floor panel substantially consists of synthetic material and is of the supple type;

wherein the floor panel, on at least one pair of opposite edges, comprises coupling parts which allow joining two of such floor panels by means of a downward movement (M) of one floor panel in respect to the other floor panel, wherein these coupling parts allow a locking in a first direction (V) perpendicular to the plane of the floor panels as well as in a second direction (H) perpendicular to the respective edge and in the plane of the floor panels;

wherein the coupling parts comprise a first locking system for the locking in said first direction and a second locking system for the locking in said second direction;

wherein the second locking system substantially is formed of an upwardly directed lower hook-shaped part situated on an edge, as well as of a downwardly directed upper hook-shaped part situated on the opposite edge, which hook-shaped parts, when interconnecting two such floor panels, can be engaged behind each other by said downward movement (M);

wherein the lower hook-shaped part consists of a lip which extends laterally from the lower edge of the panel and which is provided with an upwardly directed locking element with a locking surface, whereas the upper hook-shaped part consists of a lip which extends laterally from the upper edge of the panel and which is provided with a downwardly directed locking element with a locking surface;

wherein said first locking system comprises a separate locking element;

wherein the locking element is provided in a longitudinal recess which is present on the respective edge at a distance underneath the upper surface and is separated from the upper surface by a lip-shaped part;

wherein the lip-shaped part, in a cross-section, comprises a proximal end and a distal end and wherein the distal end defines an upper edge;

wherein the lip-shaped part, near the proximal end, has a thickness (B), herein below denominated proximal thickness (B), wherein the proximal thickness (B) is formed by a distance perpendicular to the upper surface, measured from the upper surface to a tangent point determined by a line at an angle (A1) of 60° with said upper surface, which is directed downward in proximal direction and which is tangential to said recess;

wherein the lip-shaped part, in a cross-section, has a horizontal length (A) which is formed by the horizontal distance between the most distal end of the lip-shaped part and the most proximal point of said recess; and wherein the floor panel combines the following two features:

said recess is bordered by a bottom wall consisting at least of a first portion and a second portion, of which the second portion is situated more inwardly than the first portion and also is situated lower than the first portion;

said lip-shaped part shows at least one of the following features or a combination of any two or three of the following features, or all four of the following features:

the ratio (B/A) of said proximal thickness (B) to said horizontal length (A) is larger than 0.75;

said recess is situated over its entire depth, possibly with the exception of the first 10% of its depth, below an imaginary line which extends through said upper edge and is inwardly sloping downward over an angle (A3) of 36 degrees;

said horizontal length (A), or thus the depth of the recess, is less than 2.4 mm;

said horizontal length is smaller than 0.4 times the overall thickness (T) of the floor panel;

wherein said floor panel has a suppleness defined such that when the floor panel has a rectangular shape with a pair of short sides and a pair of long sides, with a width of less than 50 centimeters measured along one side of the short sides, and when the floor panel is fixedly clamped on one side of the pair of short sides of the floor panel to project over a length of 100 centimeters, the floor panel, starting from a flat horizontal position, will bend under the influence of its own weight, such that at a height of a free extremity portion of the floor panel, the bending is at least 10 centimeters in respect to a clamped portion of the floor panel, when a bending time of at least 10 seconds is considered.

6. The floor panel of claim 5, wherein the locking element is at least composed of an attachment portion and a pivotable blocking body.

7. The floor panel of claim 5, wherein the locking element is made in the form of a displaceable tongue.

8. The floor panel of claim 5, wherein the floor panel has a thickness (T) of less than 6 mm.

9. A floor panel for forming a floor covering, wherein the floor panel substantially consists of synthetic material and is of the supple type;

wherein the floor panel, on at least one pair of opposite edges, comprises coupling parts which allow joining two of such floor panels by means of a downward movement of one floor panel in respect to the other floor panel, wherein these coupling parts allow a locking in a first direction (V) perpendicular to the plane of the floor panels as well as in a second direction (H) perpendicular to the respective edge and in the plane of the floor panels;

wherein the coupling parts comprise a first locking system for the locking in said first direction (V) and a second locking system for the locking in said second direction (H);

wherein the second locking system substantially is formed of an upwardly directed lower hook-shaped part situated on an edge, as well as of a downwardly directed upper hook-shaped part situated on the opposite edge, which hook-shaped parts, when interconnecting two such floor panels, can be engaged behind each other by said downward movement (M);

wherein the lower hook-shaped part consists of a lip which extends laterally from the lower edge of the panel and which is provided with an upwardly directed locking element with a locking surface, whereas the upper hook-shaped part consists of a lip which extends laterally from the upper edge of the panel and which is provided with a downwardly directed locking element with a locking surface;

wherein the lower hook-shaped part comprises an engagement portion for the upper hook-shaped part;

wherein said first locking system comprises a separate locking element;

wherein the locking element is provided in a longitudinal recess which is present on the respective edge at a distance underneath the upper surface and is separated from the upper surface by a lip-shaped part;

wherein the lip-shaped part, in a cross-section, comprises a proximal end and a distal end and wherein the distal end defines an upper edge;

wherein the lip-shaped part, near the proximal end, has a thickness (B), herein below denominated proximal thickness (B), wherein the proximal thickness (B) is formed by a distance perpendicular to the upper surface, measured from the upper surface to a tangent point determined by a line at an angle (A1) of 60° with said upper surface, which is directed downward in proximal direction and which is tangential to said recess;

wherein the lip-shaped part, in a cross-section, has a horizontal length (A) which is formed by the horizontal distance between the most distal end of the lip-shaped part and the most proximal point of said recess; and wherein said engagement portion has a length (L) which is greater than or equal to 1.2 times the aforementioned horizontal length (A), and, is smaller than or equal to 1.8 times the horizontal length (A);

wherein said floor panel has a suppleness defined such that when the floor panel has a rectangular shape with a pair of short sides and a pair of long sides, with a width of less than 50 centimeters measured along one side of the short sides, and when the floor panel is fixedly clamped on one side of the pair of short sides of the floor panel to project over a length of 100 centimeters, the floor panel, starting from a flat horizontal position, will bend under the influence of its own weight, such that at a height of a free extremity portion of the floor panel, the bending is at least 10 centimeters in respect to a clamped portion of the floor panel, when a bending time of at least 10 seconds is considered.

10. The floor panel of claim 9, wherein the locking element is at least composed of an attachment portion and a pivotable blocking body.

11. The floor panel of claim 9, wherein the locking element is made in the form of a displaceable tongue.

12. The floor panel of claim 9, wherein the floor panel has a thickness (T) of less than 6 mm.

13. The floor panel of claim 9, wherein it also shows one or more of the following features:

the ratio (B/A) of said proximal thickness (B) to said horizontal length (A) is larger than 0.75;

said recess is situated over its entire depth, possibly with the exception of the first 10% of its depth, below an imaginary line which extends through said upper edge and is inwardly sloping downward over an angle (A3) of 36 degrees;

said horizontal length (A), or thus the depth of the recess, is less than 2.4 mm;

said horizontal length is smaller than 0.4 times the overall thickness (T) of the floor panel;

said locking surfaces are configured such that they, in coupled condition, at a location where they contact each other, form an angle with the plane of the floor panel which is different from 90 degrees;

the recess is bordered by a bottom wall which consists at least of a first portion and a second portion, of which the second portion is situated more inwardly than the first portion and is also situated lower than the first portion.

14. A floor panel for forming a floor covering, wherein the floor panel substantially consists of synthetic material and is of the supple type;

wherein the floor panel, on at least one pair of opposite edges, comprises coupling parts which allow joining two of such floor panels by means of a downward movement (M) of one floor panel in respect to the other floor panel, wherein these coupling parts allow a locking in a first direction (V) perpendicular to the plane of the floor panels as well as in a second direction (H) perpendicular to the respective edge and in the plane of the floor panels;

wherein the coupling parts comprise a first locking system for the locking in said first direction and a second locking system for the locking in said second direction;

wherein the second locking system substantially is formed of an upwardly directed lower hook-shaped part situated on an edge, as well as of a downwardly directed upper hook-shaped part situated on the opposite edge, which hook-shaped parts, when interconnecting two such floor panels, can be engaged behind each other by said downward movement (M);

wherein the lower hook-shaped part consists of a lip which extends laterally from the lower edge of the panel and which is provided with an upwardly directed locking element with a locking surface, whereas the upper hook-shaped part consists of a lip which extends laterally from the upper edge of the panel and which is provided with a downwardly directed locking element with a locking surface;

wherein the lower hook-shaped part comprises an engagement portion for the upper hook-shaped part;

wherein said first locking system comprises a separate locking element;

wherein the locking element is provided in a longitudinal recess which is present on the respective edge at a distance underneath the upper surface and is separated from the upper surface by a lip-shaped part;

wherein the lip-shaped part, in a cross-section, comprises a proximal end and a distal end; and wherein said lip-shaped part, at the distal end thereof, has a global thickness (T1) which is larger than 15% of the overall thickness (T) of the floor panel, whereas the smallest thickness (T2) of said lower lip, at the location of the engagement portion thereof, is larger than 30% of the overall thickness (T) of the floor panel;

wherein said floor panel has a suppleness defined such that when the floor panel has a rectangular shape with a pair of short sides and a pair of long sides, with a width of less than 50 centimeters measured along one side of the short sides, and when the floor panel is fixedly clamped on one side of the pair of short sides of the floor panel to project over a length of 100 centimeters, the floor panel, starting from a flat horizontal position, will bend under the influence of its own weight, such that at a height of a free extremity portion of the floor panel, the bending is at least 10 centimeters in respect to a clamped portion of the floor panel, when a bending time of at least 10 seconds is considered.

15. The floor panel of claim 14, wherein the locking element is at least composed of an attachment portion and a pivotable blocking body.

16. The floor panel of claim 14, wherein the locking element is made in the form of a displaceable tongue.

17. The floor panel of claim 14, wherein the floor panel has a thickness (T) of less than 6 mm.

18. The floor panel of claim 14, wherein the lip-shaped part, next to the proximal end, has a thickness (B), herein below denominated proximal thickness (B), wherein the proximal thickness (B) is formed by a distance perpendicular to the upper surface, measured from the upper surface to a tangent point determined by a line at an angle (A1) of 60° with said upper surface, which is directed downward in proximal direction and which is tangential to said recess;

wherein the lip-shaped part, in a cross-section, has a horizontal length (A) which is formed by the horizontal distance between the most distal end of the lip-shaped part and the most proximal point of said recess; and wherein the floor panel also shows one or more features selected from the following list:

the ratio (B/A) of said proximal thickness (B) to said horizontal length (A) is larger than 0.75;

said recess is situated over its entire depth, possibly with the exception of the first 10% of its depth, below an imaginary line which extends through said upper edge and is inwardly sloping downward over an angle (A3) of 36 degrees;

said horizontal length (A), or thus the depth of the recess, is less than 2.4 mm;

said horizontal length is smaller than 0.4 times the overall thickness (T) of the floor panel;

said locking surfaces are configured such that they, in coupled condition, at a location where they contact each other, form an angle with the plane of the floor panel which is different from 90 degrees;

the recess is bordered by a bottom wall which consists at least of a first portion and a second portion, of which the second portion is situated more inwardly than the first portion and is also situated lower than the first portion;

the lower hook-shaped part comprises an engagement portion for the upper hook-shaped part, wherein said engagement portion has a length (L) which is greater than or equal to 1.2 times the aforementioned horizontal length (A), and is smaller than or equal to 1.8 times the horizontal length (A).

19. The floor panel of claim 1, wherein said recess extends with a uniform cross-section through the entire edge concerned.

20. The floor panel of claim 1, wherein the floor panel is rectangular, either oblong rectangular or square; wherein said pair of opposite edges forms a first pair of edges, whereas the remaining two opposite edges form a second pair of edges; wherein on the second pair of edges of the floor panel, coupling parts are provided, of the type which allows coupling two of such floor panels to each other along the respective edge by means of a turning movement (W), wherein these coupling parts provide for a vertical and a horizontal locking and are made in one piece with the floor panel.

21. The floor panel of claim 20, wherein the coupling means on the first pair of edges and the second pair of edges are formed such that such panels can be a fold down installed via principle, wherein the coupling parts on the second pair of edges allow coupling the panels, via a downward turning movement, to panels of a preceding row, whereas as a result of such turning movements a locking on the first edges with an adjacent panel is effected as well.

22. The floor panel of claim 1, wherein the separate locking element is made as an insert in the form of a strip, wherein the separate locking element comprises at least a portion which is laterally movable and in the manner can cooperate with a locking portion on an adjacent similar floor panel.

23. The floor panel of claim 22, wherein said laterally movable portion is elastically movable, such that this portion, during coupling of two such floor panels, is moved sideways, against an elastic force, in order to then come back into a locking position.

24. The floor panel of claim 1, wherein the floor panel, or at least the substrate of the floor panel, substantially is composed of a thermoplastic material.

25. The floor panel of claim 1, wherein the floor panel substantially is composed of a substrate and a top layer.

26. The floor panel of claim 1, wherein the floor panel, or at least the substrate of the floor panel, substantially is composed of soft polyvinyl chloride.

27. The floor panel of claim 1, wherein the floor panel is a vinyl panel or tile including a panel of a LVT type ("Luxury Vinyl Tile") or VCT type ("Vinyl Composite Tile", also called "Vinyl Composition Tile").

28. The floor panel of claim 1, wherein the floor panel, or at least the substrate of the floor panel, substantially is formed on the basis of polyurethane or polypropylene.

29. The floor panel of claim 1, wherein it comprises a substrate which is provided with fillers.

30. The floor panel of claim 1, wherein it is provided with a reinforcement layer.

* * * * *